US006802158B1

(12) United States Patent
Greene

(10) Patent No.: US 6,802,158 B1
(45) Date of Patent: Oct. 12, 2004

(54) STORAGE SHED WITH PREFORMED ROOF ASSEMBLY

(75) Inventor: Michael Greene, Reno, NV (US)

(73) Assignee: Thinking Outside, L.L.C., Detroit, MI (US)

( * ) Notice: Subject to any disclaimer, the term of this patent is extended or adjusted under 35 U.S.C. 154(b) by 27 days.

(21) Appl. No.: 10/265,015

(22) Filed: Oct. 3, 2002

Related U.S. Application Data

(60) Provisional application No. 60/373,367, filed on Apr. 16, 2002.

(51) Int. Cl.[7] ..... E04B 1/38; E04H 1/12

(52) U.S. Cl. ..... 52/79.5; 52/36.2; 52/79.9; 52/270; 52/282.1; 52/745

(58) Field of Search ..... 52/36.2, 79.5, 52/79.6, 79.9, 270, 282.1, 282.3, 282.5, 745, 461; 312/100, 108, 263, 264, 265.5

(56) References Cited

U.S. PATENT DOCUMENTS

| | | | | | |
|---|---|---|---|---|---|
| 4,166,343 | A | | 9/1979 | O'Brian et al. | |
| 4,570,392 | A | | 2/1986 | Oltman et al. | |
| 5,033,493 | A | | 7/1991 | Senchuck | |
| 5,121,710 | A | * | 6/1992 | Gonzalez | 119/498 |
| 5,555,681 | A | | 9/1996 | Cawthon | |
| D375,168 | S | | 10/1996 | Hunt et al. | |
| D384,419 | S | | 9/1997 | Dickinson et al. | |
| 5,706,620 | A | * | 1/1998 | De Zen | 52/220.2 |
| 5,890,338 | A | * | 4/1999 | Rodriguez-Ferre | 52/582.1 |
| 5,970,663 | A | | 10/1999 | McDonough | |
| D416,091 | S | | 11/1999 | Ohanesian | |
| 6,058,660 | A | | 5/2000 | Melton | |
| 6,089,383 | A | | 7/2000 | Heneveld | |
| 6,113,203 | A | * | 9/2000 | Chen | 312/258 |
| 6,250,022 | B1 | * | 6/2001 | Paz et al. | 52/79.5 |
| 6,418,672 | B1 | * | 7/2002 | Hampel | 52/79.1 |
| 6,550,216 | B1 | * | 4/2003 | Ohanesian | 52/783.11 |
| 6,591,558 | B1 | * | 7/2003 | De Zen | 52/91.3 |
| 6,631,590 | B1 | * | 10/2003 | Glowaski | 52/63 |
| 6,701,678 | B1 | * | 3/2004 | Skov et al. | 52/79.9 |

* cited by examiner

*Primary Examiner*—Robert Canfield
(74) *Attorney, Agent, or Firm*—Townsend and Townsend and Crew LLP

(57) ABSTRACT

Embodiments of the present invention are directed to a storage shed that is strong, durable, low-maintenance, easy to assemble and use, and relatively inexpensive to manufacture and ship, and can be mass produced. In one embodiment, a storage shed comprises a preformed floor; a plurality of preformed, plastic corner posts having bottoms which are configured to be mounted onto the floor to be spaced from each other, and two preformed, plastic braces having bottoms which are configured to be mounted onto the floor to be spaced from one another. A preformed roof truss is configured to be connected to tops of the two braces. The roof truss has a spring preload to pull the tops of the two braces toward one another. A preformed roof is attached to tops of the plurality of corner posts. A preformed front door is supported between two of the plurality of corner posts.

20 Claims, 20 Drawing Sheets

STORAGE SHED WITH PREFORMED ROOF ASSEMBLY

CROSS-REFERENCES TO RELATED APPLICATIONS

This application is based on and claims the benefit of U.S. Provisional Patent Application No. 60/373,367, filed Apr. 16, 2002, the entire disclosure of which is incorporated herein by reference.

BACKGROUND OF THE INVENTION

The present invention relates generally to storage buildings and, more particularly, to a storage shed that is strong, durable, low-maintenance, easy to assemble and use, and relatively inexpensive to manufacture and ship, and can be mass produced.

Storage building are widely used commercially and by home owners for a variety of purposes. Smaller sheds that can be mass produced and assembled by home owners are popular for storing garden equipment, tools, and the like. Metal sheds are subject to rust and tend to require more maintenance than plastic sheds. While custom-built sheds may have a variety of organizational features, mass produced sheds tend to have basically four walls, a roof, and a door. Tools and equipment are of ten piled in the shed in a disorganized and cluttered manner, making them hard to access, locate, and retrieve. Moreover, such sheds are usually dark inside, so that a flashlight is needed. In addition, even a simple shed may be difficult and time-consuming to assemble.

BRIEF SUMMARY OF THE INVENTION

Embodiments of the present invention are directed to a storage shed that is strong, durable, low-maintenance, easy to assemble and use, and relatively inexpensive to manufacture and ship, and can be mass produced. In addition to a front door, the shed includes one or more side access doors that allow access to different parts of the shed without the need for the user to physically enter the shed through the front door. The shed includes built-in organizational features such as shelves that a user can selectively install according to his or her needs. One or more skylights are provided on the roof. Plastic materials are desirably used to provide strong, durable, and low-maintenance components that can be mass produced at a reasonable cost. The shed components are designed to be easy and quick to assemble without the need for any tools, except a flat blade or a flat-head screw driver.

In accordance with an aspect of the present invention, a storage shed comprises a preformed floor, and a plurality of preformed, plastic corner posts having bottoms which are configured to be mounted onto the floor to be spaced from each other. A preformed roof is attached to tops of the plurality of corner posts. A preformed front door is hingedly supported between two of the plurality of corner posts. At least one preformed side door is hingedly supported between two of the plurality of corner posts to permit access to an interior of the storage shed through the side door.

In some embodiments, the preformed, plastic corner posts each form a bent around a corner of the shed. A bay may be connected between two of the plurality of corner posts, and includes a bottom which is configured to be mounted onto the floor. The bay comprises a lower wall having the bottom which is configured to be mounted onto the floor and a plurality of upward projections along a top edge, a bay working surface having a plurality of edge apertures configured to receive the upward projections therethrough to position the bay working surface over the top edge of the lower wall, an upper wall which is attached to the lower wall, and a bay roof which is attached to the upper wall. The bay is connected to the two corner posts by a plurality of plastic bolts threadingly engaging apertures provided in the bay and the two corner posts, wherein the plastic bolts each have a wing at a head of the bolt which is configured to be turned by fingers of a hand of a user.

In specific embodiments, the front door and at least one side door each include a hasp for receiving a lock from outside the shed. The roof includes at least one preformed skylight. At least one preformed, plastic center post is disposed between two of the plurality of preformed, plastic corner posts. The center post has a bottom which is configured to be mounted onto the floor. At least one preformed side door is hingedly supported between one center post and one corner post. At least one preformed, plastic brace is connected to one center post at an angle. Each brace has a bottom which is configured to be mounted to the floor. Each brace is generally perpendicular to the center post to which the brace is connected, and the brace has a height generally equal to the height of the center post to which the brace is connected. Each brace includes a plurality of side bumps which are aligned with and received into a plurality of slots of the center post. One brace includes at least one groove and one corner post includes at least one groove aligned with the groove of the brace to receive ends of a shelf to be positioned between the brace and the corner post. The shelf comprises at least one indentation disposed in a middle region of the shelf, which is configured to receive an end of a vertical support member to be placed between the floor and the shelf or between a pair of shelves vertically spaced from one another and having indentations which are generally aligned with one another. The bottoms of the corner posts include a plurality of protrusions which are each configured to be inserted into the floor and engage a floor locking nut to be tightened to lock the protrusions to the floor.

In accordance with another aspect of the invention, a method of assembling a storage shed comprises providing a preformed floor; mounting bottoms of a plurality of preformed, plastic corner posts onto the floor which are spaced from each other; and attaching a preformed roof to tops of the plurality of corner posts. A preformed front door is hingedly supported between two of the plurality of corner posts. At least one side door is hingedly supported between two of the plurality of corner posts to permit access to an interior of the storage shed through the side door.

In some embodiments, the roof includes at least one opening and at least one preformed skylight which is attached to the opening of the roof by a snap-on connection. The method may further comprise mounting a bottom of at least one preformed, plastic center post onto the floor at a location between two of the plurality of preformed, plastic corner posts; and attaching the preformed roof to a top of the center post. At least one shelf may be slid between a groove on the brace and a groove on one of the plurality of corner posts which is aligned with the groove on the brace. A vertical support member may be placed between the floor and an indentation disposed in a middle region of the shelf to support the shelf between the brace and the corner post.

In accordance with an aspect of the present invention, a storage shed comprises a preformed floor; a plurality of preformed, plastic corner posts having bottoms which are configured to be mounted onto the floor to be spaced from each other; and two preformed, plastic braces having bottoms which are configured to be mounted onto the floor to be spaced from one another. A preformed roof truss is configured to be connected to tops of the two braces. The roof truss has a spring preload to pull the tops of the two braces toward one another. A preformed roof is attached to tops of the plurality of corner posts. A preformed front door is supported between two of the plurality of corner posts.

In some embodiments, the braces each include a boss with a narrow neck at the top thereof. The roof truss includes an elongated aperture at each end having an enlarged aperture portion and a narrow aperture portion which is disposed between the enlarged aperture portion and the end of the roof truss. The boss of each brace is configured to be inserted through the enlarged portion and slide the narrow neck to the narrow portion of the aperture under the spring preload to pull the tops of the two braces toward one another. The roof truss comprises a lower roof truss which is formed with the spring preload and which includes the apertures at the ends thereof The roof comprises two roof panels disposed on opposite sides of the lower roof truss. The roof truss comprises an upper roof truss which is attached to the lower roof truss and forms a sealed connection between the two roof panels.

In specific embodiments, two preformed, plastic center posts are each connected to one of the braces at an angle. Each center post has a bottom which is configured to be mounted onto the floor. Each brace is generally perpendicular to the center post to which the brace is connected, and has a height generally equal to the height of the center post to which the brace is connected. Each brace includes a plurality of side bumps which are aligned with and received into a plurality of slots of the center post. The bottoms of the center posts include a plurality of protrusions which are each configured to be inserted into the floor and engage a floor locking nut to be tightened to lock the protrusions to the floor. The bottom of each brace includes a hook-shaped projection which is configured to be inserted into a slot of the floor. Each brace includes at least one groove and each corner post includes at least one groove aligned with the groove of the brace to receive ends of a shelf to be positioned between the brace and the corner post. At least one indentation is disposed in a middle region of the shelf, and is configured to receive an end of a vertical support member to be placed between the floor and the shelf or between a pair of shelves vertically spaced from one another and having indentations which are generally aligned with one another.

In accordance with another aspect of the invention, a method of assembling a storage shed comprises providing a preformed floor; mounting bottoms of a plurality of preformed, plastic corner posts onto the floor which are spaced from each other; and mounting bottoms of two preformed, plastic braces onto the floor which are spaced from one another. A preformed roof truss is connected to tops of the two braces, and has a spring preload to pull the tops of the two braces toward one another. A preformed roof is attached to tops of the plurality of corner posts. A preformed front door is supported between two of the plurality of corner posts.

In some embodiments, connecting the roof truss comprises inserting a first boss with a narrow neck at the top of a first brace through a first aperture provided near a first end of a lower roof truss of the roof truss, and inserting a second boss with a narrow neck at the top of a second brace through a second aperture provided near a second end of the lower roof truss of the roof truss. The first aperture includes an enlarged aperture portion and a narrow aperture portion which is disposed between the enlarged aperture portion and the first end of the lower roof truss. The second aperture includes an enlarged aperture portion and a narrow aperture portion which is disposed between the enlarged aperture portion and the second end of the lower roof truss. The spring preload in the lower roof truss slides the narrow neck of the first boss to the narrow portion of the first aperture near the first end of the lower roof truss and slides the narrow neck of the second boss to the narrow portion of the second aperture near the second end of the lower roof truss, thereby pulling the tops of the two braces toward one another.

In specific embodiments, attaching the roof comprises positioning a first roof panel on a first side of the lower roof truss and attaching the first roof panel to one or more corner posts disposed on the first side of the lower roof truss, and positioning a second roof panel on a second side of the lower roof truss and attaching the second roof panel to one or more corner posts disposed on the second side of the lower roof truss. An upper roof truss of the roof truss is attached to the lower roof truss and forms a sealed connection between the first and second roof panels.

In some embodiments, the method further comprises mounting bottoms of two preformed, plastic center posts onto the floor which are spaced from one another; and connecting one brace to one center post and the other brace to the other center post. Each brace is connected to the center post by aligning a plurality of side bumps of the brace with a plurality of slots of the center post which receive the plurality of side bumps. The method may further comprise providing at least one shelf; and sliding the at least one shelf between a groove on one of the braces and a groove on one of the plurality of corner posts which is aligned with the groove on the brace. A vertical support member may be placed between the floor and an indentation disposed in a middle region of the shelf to support the shelf between the brace and the corner post.

An aspect of the present invention is directed to an attachment device for attaching a support post to a floor having a top, a bottom, a floor opening between the top and the bottom, and a side edge. The attachment device comprises a floor locking nut configured to be rotatably supported at the bottom of the floor. The floor locking nut includes a nut bearing surface disposed adjacent a nut aperture and facing downward from the bottom of the floor. The nut bearing surface includes an inclined surface leading to a raised surface.

In some embodiments, a stop is disposed on a side of the raised surface opposite from the inclined surface. The floor locking nut includes a serrated outer periphery. The serrated outer periphery includes a plurality of slanted teeth. The nut aperture is elongated in one direction.

In accordance with another aspect of the invention, an attachment device is provided for attaching a support post to a floor having a top, a bottom, a floor opening between the top and the bottom, and a side edge. The attachment device comprises a floor locking nut configured to be rotatably supported at the bottom of the floor. The floor locking nut includes a pair of nut bearing surfaces disposed on opposite sides of a nut aperture and facing downward from the bottom of the floor. The nut aperture is elongated in one direction.

In some embodiments, the two nut bearing surfaces each include an inclined surface leading to a raised surface, both in either a clockwise direction or a counterclockwise direction with respect to the nut aperture. The floor locking nut further includes two stops each disposed on a side of one of the raised surfaces opposite from the inclined surface leading to the raised surface. The two nut bearing surfaces are curved to form circular segments on opposite sides of the nut aperture. The two raised surfaces are substantially planar with one another.

Another aspect of the invention is directed to a method of attaching a support post to a floor having a top, a bottom, a floor opening between the top and the bottom, and a side edge. The method comprises rotatably supporting a floor locking nut at the bottom of the floor, wherein the floor locking nut includes a nut bearing surface disposed adjacent a nut aperture and facing downward from the bottom of the floor, and the nut bearing surface includes an inclined surface leading to a raised surface. A bottom protrusion of the support post is inserted through the floor opening and the nut aperture, a top portion of the bottom protrusion having a narrow neck. The floor locking nut is turned to bring the nut bearing surface in contact with the upper portion of the bottom protrusion. The nut bearing surface guides the upper portion of the bottom protrusion with the inclined surface downward from the bottom of the floor until the upper portion of the bottom protrusion contacts the raised surface which applies a downward force on the bottom protrusion of the support post to attach the support post to the floor.

In some embodiments, the floor locking nut includes a stop disposed on a side of the raised surface opposite from the inclined surface, and the floor locking nut is turned until the upper portion of the bottom protrusion contacts the raised surface and the bottom protrusion bears against the stop. The floor locking nut includes a serrated outer periphery having a plurality of teeth, and the floor locking nut is turned by pushing against the teeth of the serrated outer periphery. The serrated outer periphery is configured to be exposed through the side edge of the floor to permit turning of the floor locking nut by pushing against the teeth of the serrated outer periphery. The serrated outer periphery includes a plurality of slanted teeth, and the floor locking nut is turned by pushing a flat blade against one of the plurality of slanted teeth.

In specific embodiments, the nut aperture is elongated, and the floor locking nut comprises two nut bearing surfaces disposed on opposite sides of the elongated nut aperture. The two nut bearing surfaces each include an inclined surface which leads to a raised surface, both in either a clockwise direction or a counterclockwise direction with respect to the elongated nut aperture. The floor locking nut is turned to guide the upper portion of the bottom protrusion with the two inclined surfaces downward from the bottom of the floor until the upper portion of the bottom protrusion contacts at least one of the two raised surfaces disposed on opposite sides of the nut aperture. The floor locking nut includes two stops each disposed on a side of one of the raised surfaces opposite from the inclined surface leading to the raised surface, and the floor locking nut is turned until the upper portion of the bottom protrusion contacts the raised surfaces and the bottom protrusion bears against at least one of the stops. The two raised surfaces arc substantially planar with one another, and the floor locking nut is turned to guide the upper portion of the bottom protrusion with the two inclined surfaces downward from the bottom of the floor until the upper portion of the bottom protrusion contacts both raised surfaces disposed on opposite sides of the nut aperture. The floor locking nut is rotatably supported at the bottom of the floor by a plurality of retainer members connected to the bottom of the floor and distributed around a periphery of the floor locking nut.

In accordance with an aspect of the present invention, a hinge assembly for hingedly connecting a door to a structural member of a shed comprises at least one hinge post disposed along a generally vertical edge of the door, and at least one hinge support provided along a generally vertical edge of the structural member. The hinge support includes a hinge support cutout portion configured to slidably support a first portion of the hinge post of the door to permit rotation of the hinge post relative to the hinge support cutout portion around an axis of the hinge post. The hinge support includes an extension which is disposed adjacent the hinge support cutout portion and extends outward from the generally vertical edge of the structural member. At least one hinge connection member has a hinge connection cutout portion configured to slidably support a second portion of the hinge post of the door which is disposed generally opposite from the first portion of the hinge post of the door to permit rotation of the hinge post relative to the hinge connection cutout portion around the axis of the hinge post. The hinge connection member is detachably coupled with the extension of the hinge support, and is configured to be attached to the structural member.

In some embodiments, the at least one hinge post is preformed along the generally vertical edge of the door. The at least one hinge support is preformed along the generally vertical edge of the structural member. The at least one hinge connection member is a preformed, plastic member. The hinge connection member includes a connection portion which is configured to be inserted through a generally vertical slot provided in the door disposed adjacent the hinge post. The connection portion has a generally vertical connection slot which is configured to detachably receive the extension of the hinge support therethrough. The hinge connection member includes a threaded aperture which is configured to threadingly receive a fastener extending through an aperture provided in the structural member to attach the hinge connection member to the structural member.

In specific embodiments, a plurality of hinge posts are distributed along the generally vertical edge of the door and a plurality of hinge supports are distributed along the generally vertical edge of the structural member. The hinge support cutout portion is a rounded cutout portion configured to partially wrap around the first portion of the hinge post, and the hinge connection cutout portion is a rounded cutout portion configured to partially wrap around the second portion of the hinge post.

In accordance with another aspect of the invention, a hinge apparatus for rotatably supporting a hinge post comprises a hinge support including a hinge support cutout portion configured to slidably support a first portion of the hinge post to permit rotation of the hinge post relative to the hinge support cutout portion around an axis of the hinge post. The hinge support includes an extension which is disposed adjacent the hinge support cutout portion. A hinge connection member has a hinge connection cutout portion configured to slidably support a second portion of the hinge post which is disposed generally opposite from the first portion of the hinge post of the door to permit rotation of the hinge post relative to the hinge connection cutout portion around the axis of the hinge post. The hinge connection member is detachably coupled with the extension of the hinge support, and is configured to be attached to another part of the hinge support to support the hinge post between the hinge support cutout portion and the hinge connection cutout portion.

In some embodiments, the hinge connection member includes a connection portion having a generally vertical connection slot which is configured to detachably receive the extension of the hinge support therethrough. The hinge connection member includes a threaded aperture which is configured to threadingly receive a fastener extending through an aperture provided in the hinge support to attach the hinge connection member to the hinge support. The hinge support cutout portion is a rounded cutout portion configured to partially wrap around the first portion of the hinge post, and the hinge connection cutout portion is a rounded cutout portion configured to partially wrap around the second portion of the hinge post.

In accordance with another aspect of the present invention, a method of hingedly connecting a door to a structural member of a shed comprises providing at least one hinge post along a generally vertical edge of the door, and providing at least one hinge support along a generally vertical edge of the structural member. The hinge support includes a hinge support cutout portion configured to slidably support a first portion of the hinge post of the door to permit rotation of the hinge post relative to the hinge support cutout portion around an axis of the hinge post. The hinge support includes an extension which is disposed adjacent the hinge support cutout portion and extends outward from the generally vertical edge of the structural member. A hinge connection member is attached to the structural member. The hinge connection member has a hinge connection cutout portion configured to slidably support a second portion of the hinge post of the door which is disposed generally opposite from the first portion of the hinge post of the door to permit rotation of the hinge post relative to the hinge connection cutout portion around the axis of the hinge post. The hinge connection member is detachably coupled with the extension of the hinge support.

In some embodiments, the hinge connection member is detachably coupled with the extension of the hinge support by inserting a connection portion of the hinge connection member through the generally vertical slot provided in the door, and inserting the extension of the hinge support through a generally vertical connection slot provided in the connection portion of the hinge connection member. Attaching the hinge connection member to the structural member comprises extending a fastener through an aperture in the structural member and threadingly engaging the fastener with a threaded aperture in the hinge connection member to attach the hinge connection member to the structural member.

In accordance with another aspect of the invention, a method of rotatably supporting a hinge post comprises providing a hinge support including a hinge support cutout portion configured to slidably support a first portion of the hinge post to permit rotation of the hinge post relative to the hinge support cutout portion around an axis of the hinge post. The hinge support includes an extension which is disposed adjacent the hinge support cutout portion. A hinge connection member has a hinge connection cutout portion configured to slidably support a second portion of the hinge post which is disposed generally opposite from the first portion of the hinge post of the door to permit rotation of the hinge post relative to the hinge connection cutout portion around the axis of the hinge post. The hinge connection member is attached to the hinge support. The hinge connection member is detachably coupled with the extension of the hinge support.

DETAILED DESCRIPTION OF THE INVENTION

Figure 1:
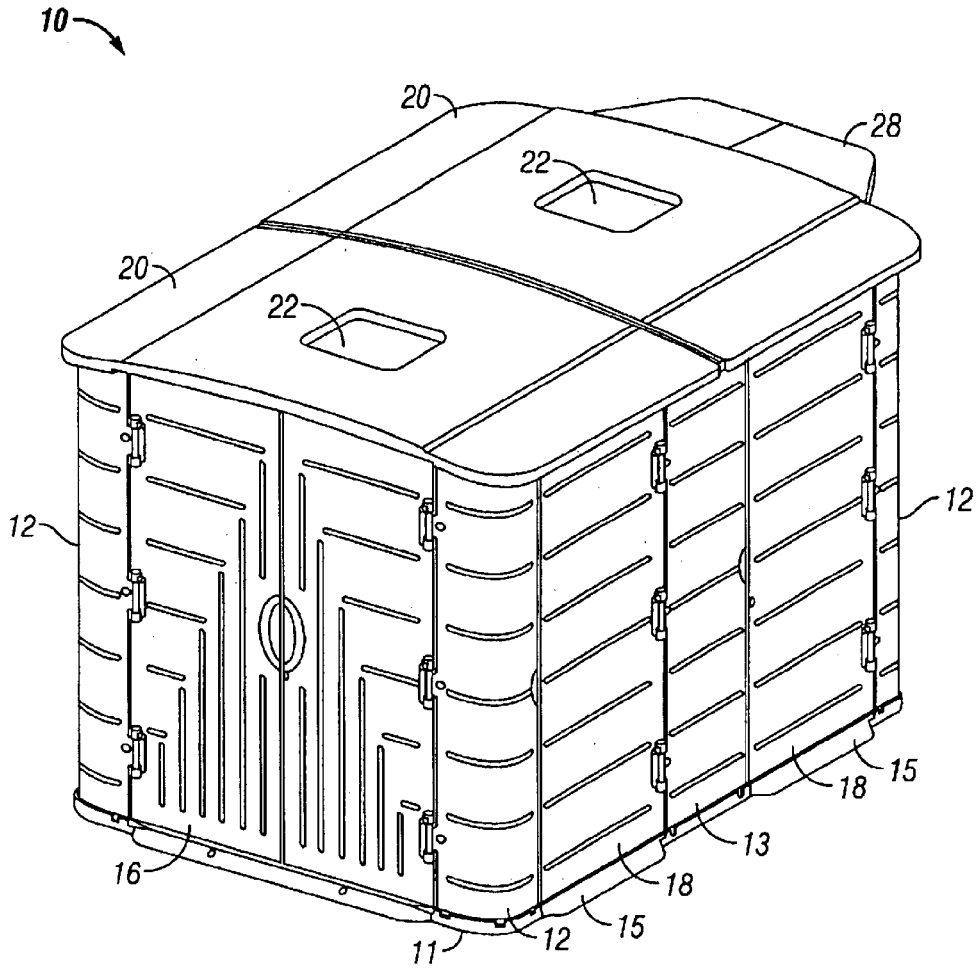
FIG. 1 is a front perspective view of the shed according to an embodiment of the present invention.
Figure 2:
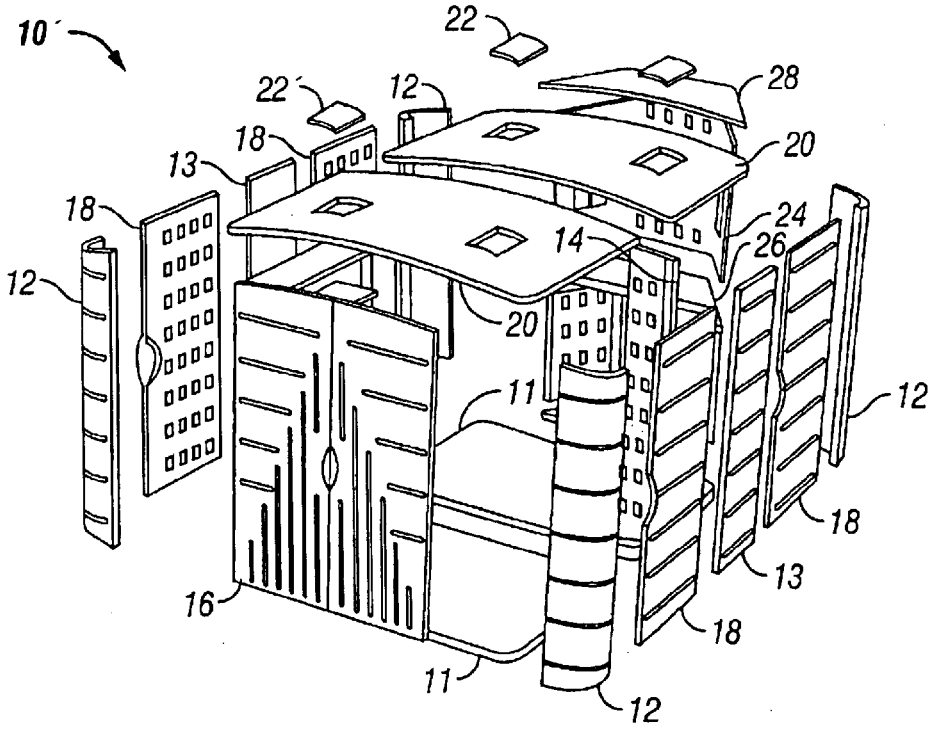
FIG. 2 is an exploded perspective view of the shed according to another embodiment of the present invention.
Figure 3:
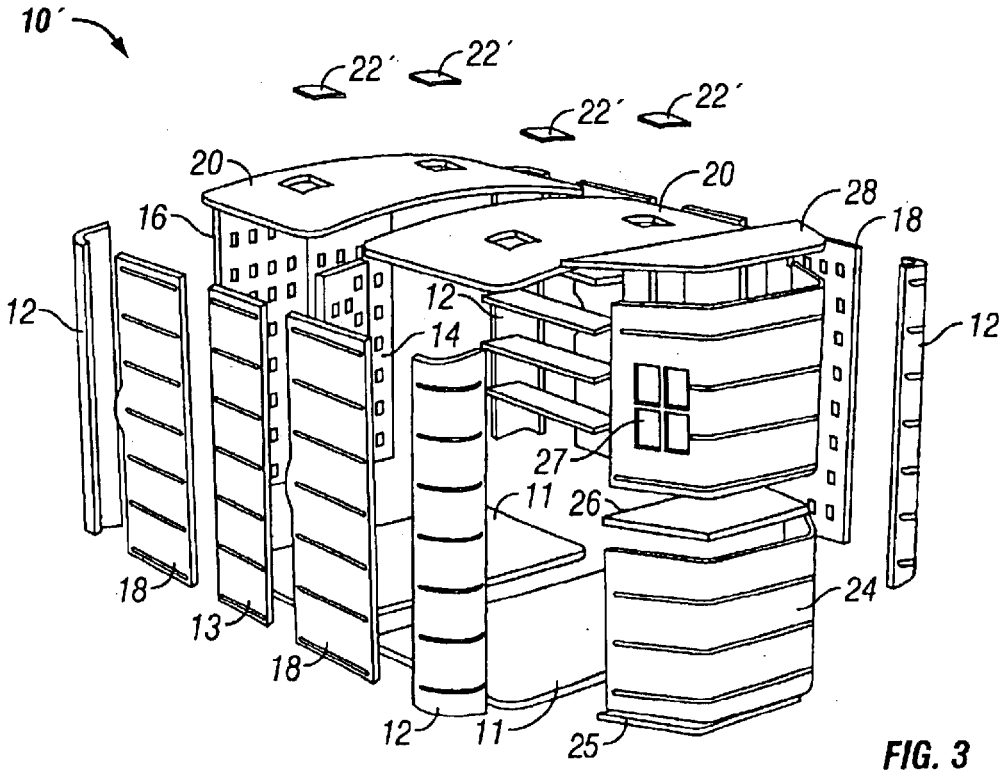
FIG. 3 is another exploded perspective view of the shed of FIG. 2.

FIG. 1 shows simplified views of a storage shed 10 according to an embodiment of the present invention. The storage shed 10 includes a floor desirably formed by two main floor pieces 11, four corner posts 12, two center posts 13, and two side frame support panels or braces 14. Each corner post 12 desirably forms a bent around a corner of the shed 10, and may have a rounded or curved exterior. The center posts 13 are typically planar in shape. The floor pieces 11 desirably include ramps 15. The shed 10 includes a plurality of doors to allow easy access to different parts of the shed 10 for storage and retrieval. In this embodiment, the shed 10 has front doors 16 and four side access doors 18. The ramps 15 are provided for the doors to allow easy access by lawnmowers, wheel barrels, and the like. The roof in this embodiment is formed by two roof panels 20, which may include one or more skylights 22. The shed 10 as shown further includes a bay 24 having a bay working surface 26, one or more optional windows, a bay floor 25, and a bay roof 28. FIGS. 2 and 3 show another embodiment of the shed 10' having additional skylights 22'. The various components of the shed 10 may be made of a variety of different materials, but desirably are preformed from plastic materials and assembled, and are strong, durable, relatively light in weight, and essentially maintenance free, and can be mass produced or preformed by molding or the like.

Figure 4:
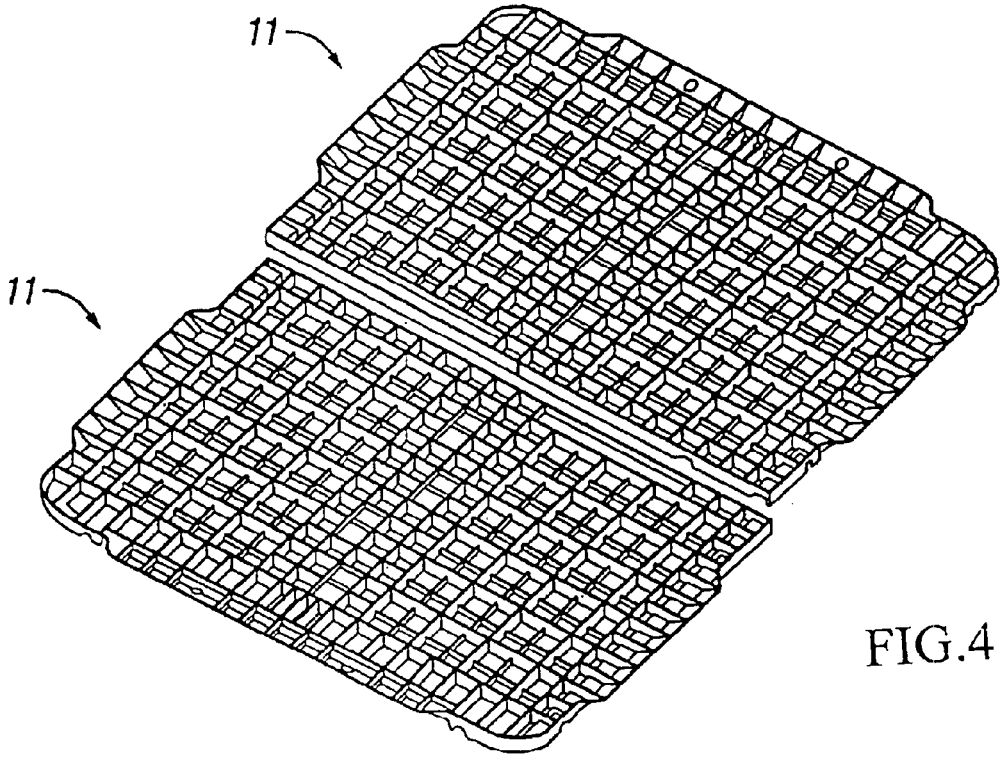
FIG. 4 is a bottom perspective view of the floor pieces of the shed of FIG. 1.
Figure 5:
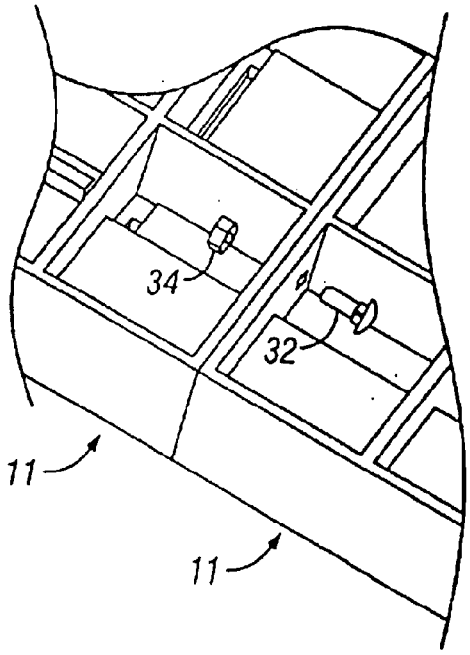
FIG. 5 is a bottom perspective view illustrating attachment of the floor pieces of FIG. 4.

FIG. 4 shows the bottom of the floor pieces 11. The main floor pieces 11 and the bay floor 25 are desirably made of structural foam or the like to provide strong, stable, and durable support for the shed 10. The floor pieces 11 are attached together using fasteners such as bolts 32 and nuts 34, as shown in FIG. 5. The bay floor 25 is attached to one of the floor pieces 11 in a similar manner. The floor pieces 11 and the bay floor 25 comprise the floor of the shed 10. In other embodiments, the shed 10 may include a single floor piece, or more than two floor pieces that are similarly fastened together. The use of multiple, smaller floor pieces may facilitate easier handling and shipping.

Figure 6:
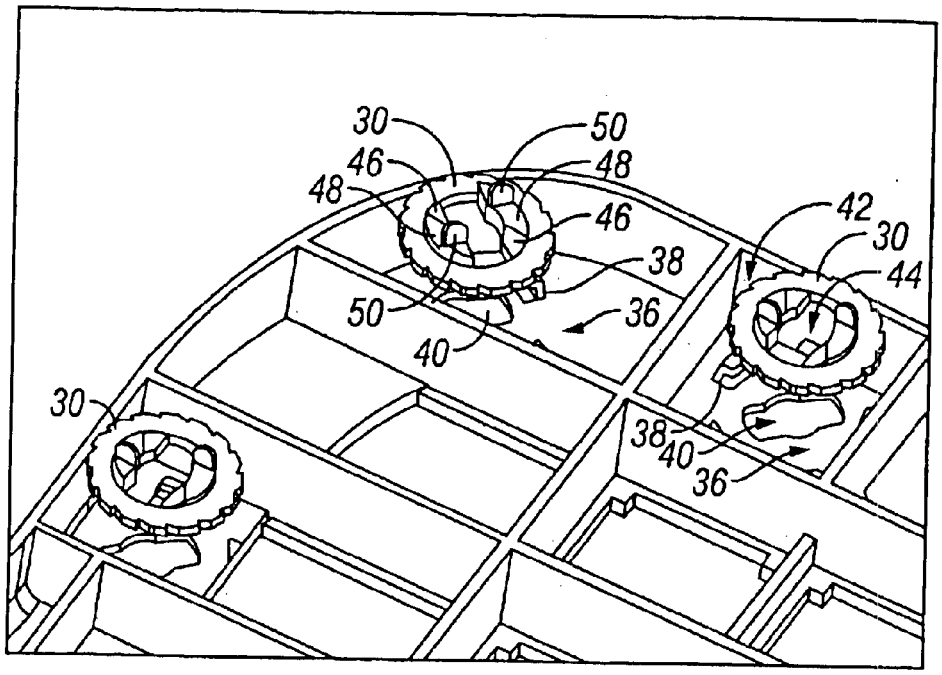
FIG. 6 is a bottom perspective view of the floor piece of FIG. 4 illustrating the floor locking nuts.
Figure 7:
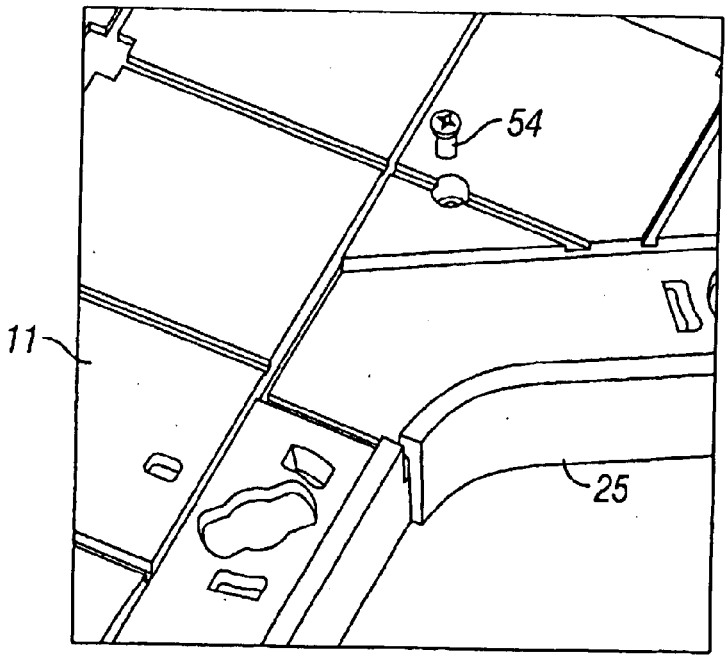
FIG. 7 is a perspective view illustrating attachment of the bay floor to the floor piece.

The four corner posts 12, two center posts 13, and bay 24 are connected to the main floor pieces 11 and bay floor 25. In the embodiment shown, a plurality of floor locking nuts 30 are used. As seen in FIG. 6, the floor locking nuts 30 are inserted into nut receiving areas or seats 36 provided at the bottom of the floor pieces 11 and bay floor 25 along the outer edges. The nut receiving seats 36 each include two or more retaining members 38 which detachably hold the floor locking nuts 30 in place when the bottoms of the floor pieces 11 and bay floor 25 are turned to face downward. The nut receiving seats 36 each include an elongated opening 40 to receive a protrusion or projection (of a post or bay) to be locked by turning the floor locking nut 30, as described in more detail below. The floor locking nut 30 includes a serrated outer edge 42 and an elongated aperture 44 for receiving the protrusion or projection through the elongated opening 40. Adjacent the aperture 44 are a pair of slanted or inclined surfaces 46 inclined upward to reach a pair of raised surfaces 48 that are substantially flat. The pair of inclined surfaces 46 are typically oppositely disposed; as are the pair of raised surfaces 48. At the end of each raised surface 48 is a wall or stop 50. After the floor locking nuts 30 are inserted into the nut receiving seats 36, the floor pieces 11 and to bay floor 25 are turned over to face the bottom of the floor downward. FIG. 7 shows an alternate way of fastening the bay floor 25 to one of the main floor pieces 11 using self-tapping screws 54 to fasten overlapped portions of the floors 11, 25.

Figure 8:
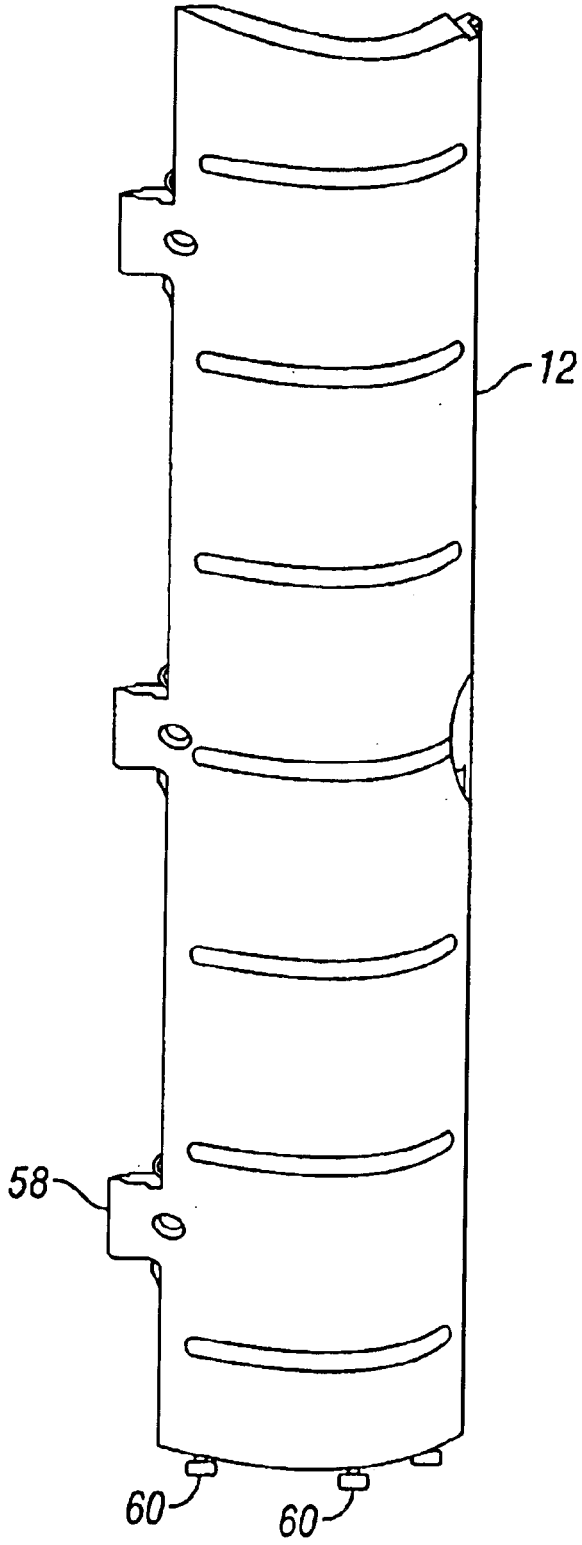
FIG. 8 is a perspective view of a corner post of the shed of FIG. 1.
Figure 9:
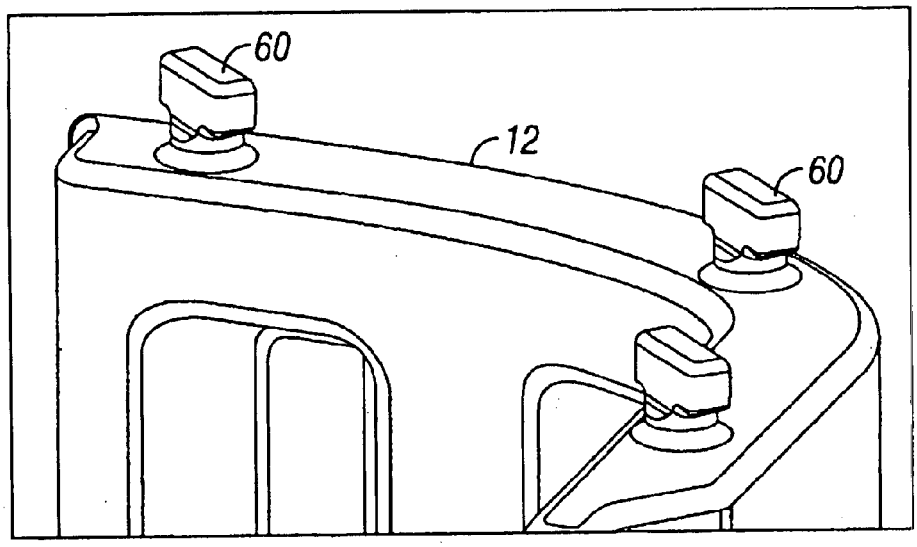
FIG. 9 is a bottom perspective view of the corner post of FIG. 8 illustrating the bottom protrusions of the corner post.
Figure 10:
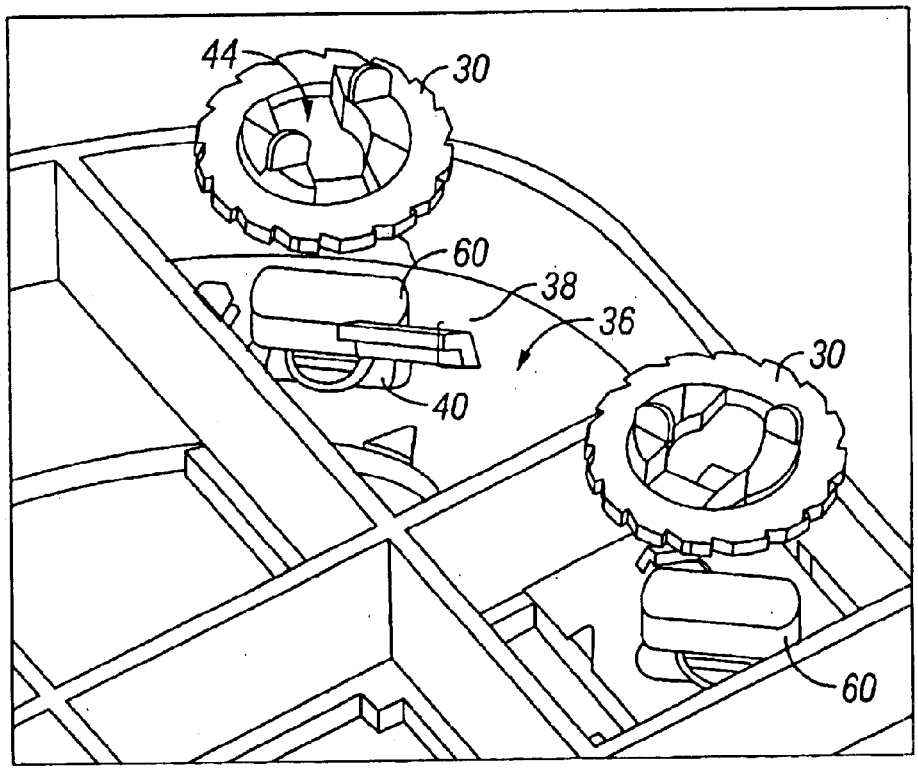
FIG. 10 is an exploded, bottom perspective view of the floor piece illustrating the locking of the bottom of the corner post to the floor piece using the floor locking nuts.

In FIG. 8, the corner post 12 includes a plurality of door hinge supports 58 along the side, and a plurality of protrusions or projections 60 at the bottom. As best seen in FIG. 9, the protrusions 60 are elongated and sized to be inserted each through an elongated opening 40 of the nut receiving seat 36 of the floor and an elongated aperture 44 of the corresponding floor locking nut 30. FIG. 10 shows the protrusions 60 inserted through the elongated openings 40 of the nut receiving seats 36. FIG. 10 shows the floor locking nuts 30 in an exploded view, but they are held in the nut receiving seats 36 during insertion of the protrusions 60 which also extend through the elongated apertures 44 of the floor locking nuts 30, as seen in FIG. 11.

Figure 11:
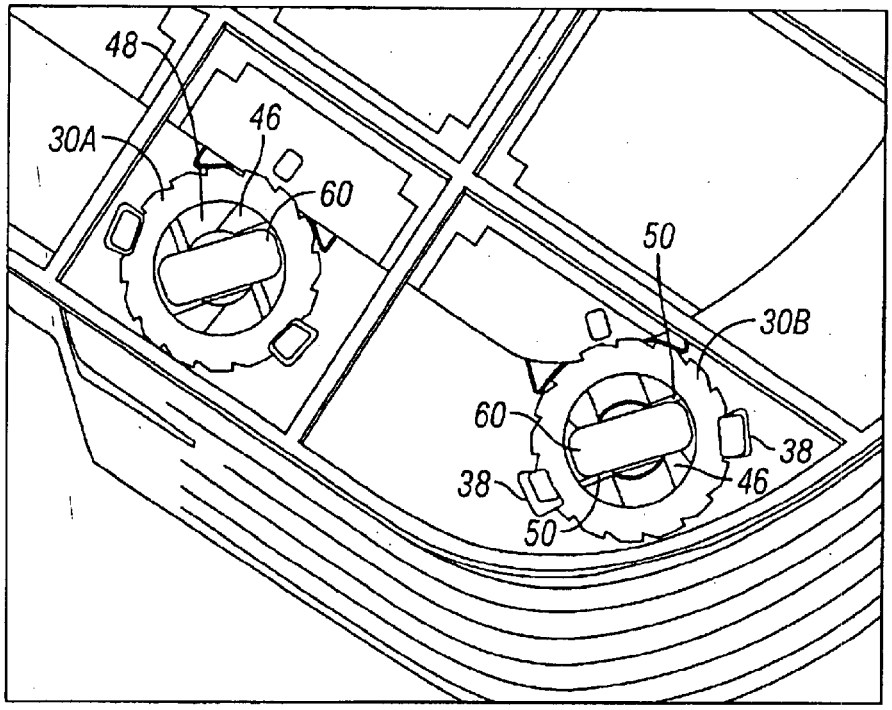
FIG. 11 is a bottom perspective view of the floor piece illustrating the locking of the bottom of the corner post to the floor piece using the floor locking nuts.
Figure 12:
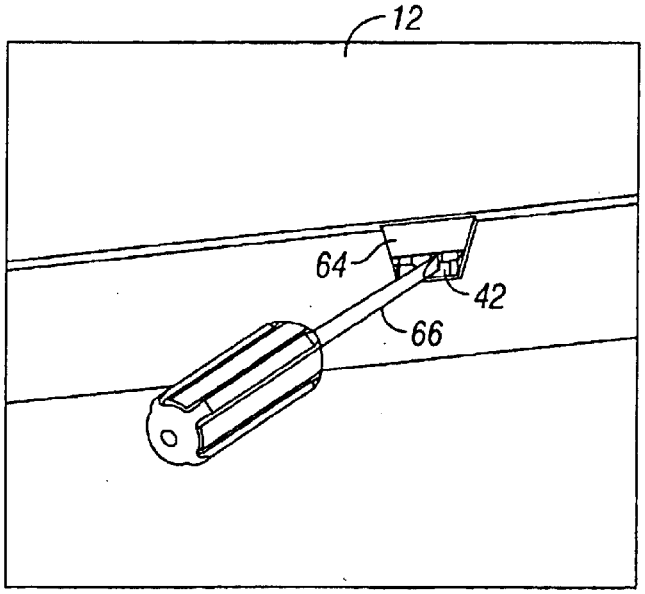
FIG. 12 is a perspective view of the exterior of the shed illustrating a way of tightening the floor locking nut.
Figure 13:
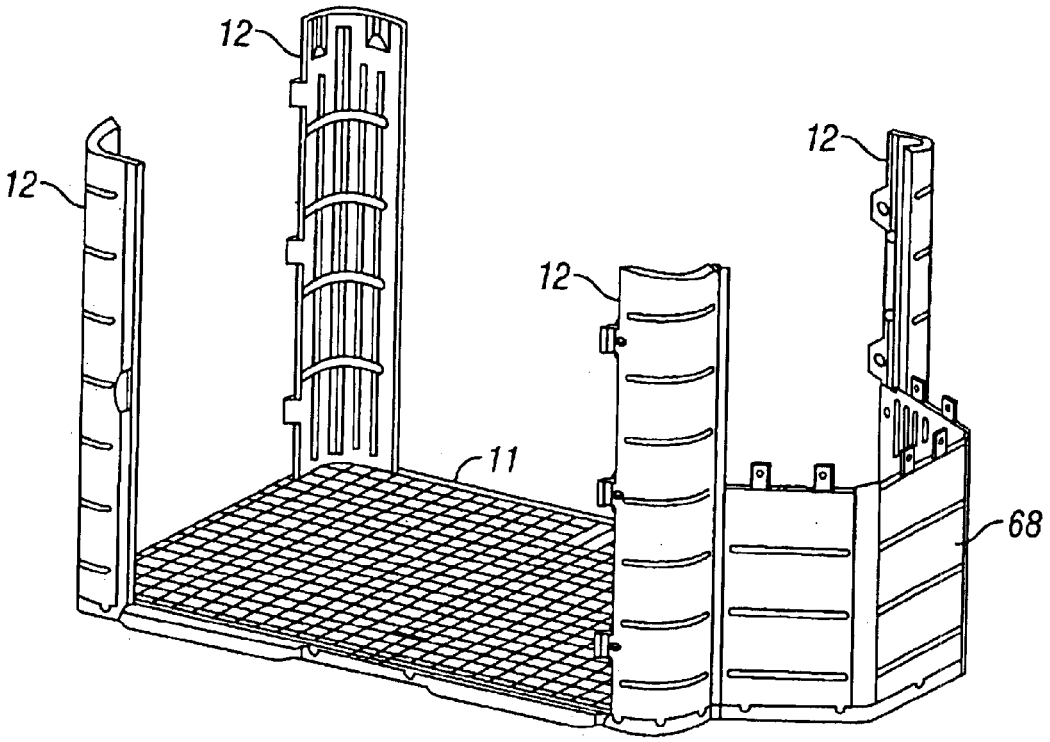
FIG. 13 is a perspective view of the corner posts and lower wall of a bay installed onto the floor in the shed of FIG. 1.

FIG. 11 shows the bottom view of a floor locking nut 30A after insertion of the protrusion 60 before tightening to lock the protrusion 60 in place. The floor locking nut 30A is tightened by turning it in the clockwise direction (from the bottom view) until it reaches the position shown as 30B in FIG. 11. As the floor locking nut 30A is turned in the clockwise direction, it guides the movement of the protrusion 60 up the inclined surfaces 46 to reach the raised surfaces 48 until the protrusion 60 abuts the projections 50, thereby pushing the protrusion 60 downward and locking it in place. Because the floor locking nuts 30 are disposed under the floor pieces 11 and bay floor 25, it is not convenient to reach under the floor to tighten the floor locking nuts 30. As shown in FIG. 12, for each floor locking nut 30 a side access or cutout 64 is conveniently provided in the side wall of the floor pieces 11 under the corner post 12 or center posts 13, or in the side wall of the bay floor 25 under the bay 24, to allow access to the serrated edge 42 of the floor locking nut 30 from the outside. The floor locking nut 30 can be tightened from the outside through the side access 64 by using a flat object, such as a blade or a flat-head screw driver 66, to push against the serrated outer edge 42 of the nut 30 to turn the nut 30 in the counter-clockwise direction (viewed from the top). The teeth of the serrated edge 42 are desirably angled or slanted to facilitate the engagement of the tool 66 with the teeth to turn the nut 30 in the proper direction. The four corner posts 12 and the lower wall 68 of the bay 24 are installed by locking them in place to the floor pieces 11 and bay floor 25 using the floor locking nuts 30, as seen in FIG. 13.

Figure 14:
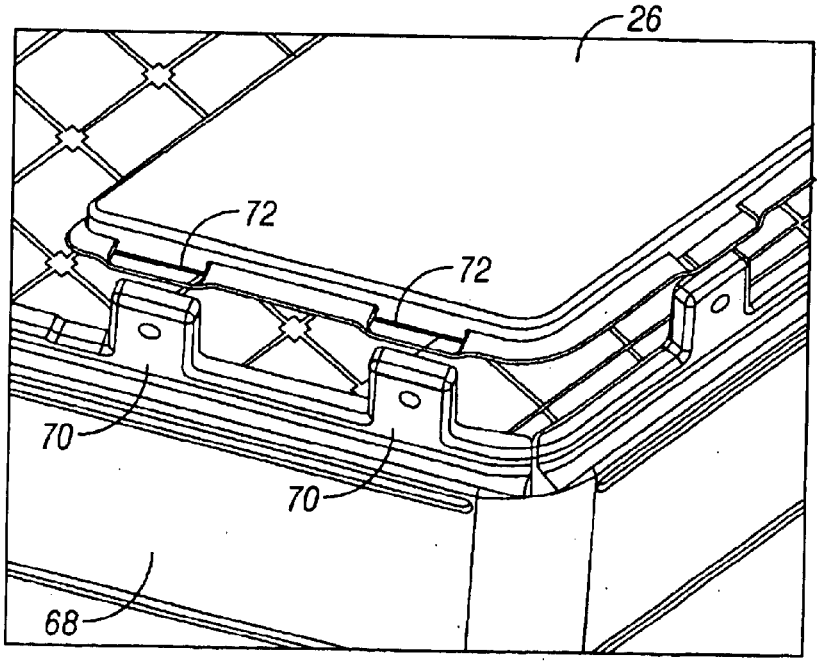
FIG. 14 is a perspective view of the bay illustrating the installation of the bay working surface.
Figure 15:
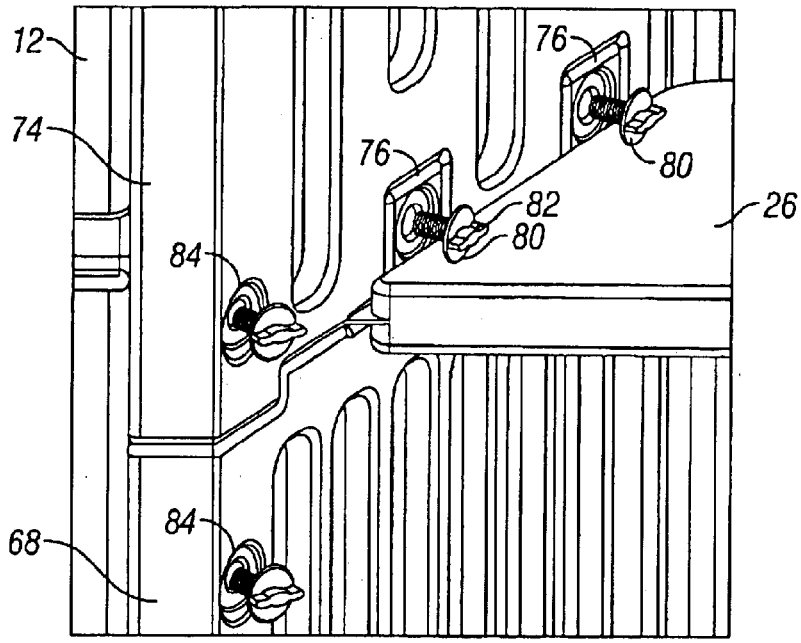
FIG. 15 is an interior perspective view of the bay illustrating a way to mount the upper wall to the lower wall of the bay.

Next, the remainder of the bay 24 is installed. One way of installing the bay working surface 26 is illustrated in FIG. 14. The lower wall 68 of the bay 24 includes a plurality of apertured upward projections 70 which extend through slotted edges 72 of the bay working surface 26. As shown in FIG. 15, the upper wall 74 of the bay 24 includes apertured portions 76 which overlap with the upward projections 70 of the lower wall 68. Each apertured upward projection 70 and the corresponding apertured portion 76 have matching apertures through which a fastener can be inserted to secure the lower wall 68 and the upper wall 74 to form the wall of the bay 24. As seen in FIG. 15, threaded bolts 80 are inserted through threaded apertures of the upward projection 70 and corresponding apertured portions 76. The bolts 80 each include a relative large wing 82 at the head which can be conveniently turned by the fingers of a user's hand without any tools. The bolts 80 are desirably made of a plastic material. Similar bolts are used to attached other components of the shed 10. For instance, bolts 84, which may be the same as the bolts 80, are used to attach the lower wall 68 and upper wall 74 of the bay 24 to the corner post 12 via threaded apertures provided along the edges of these structural components, as shown in FIG. 15.

Figure 16:
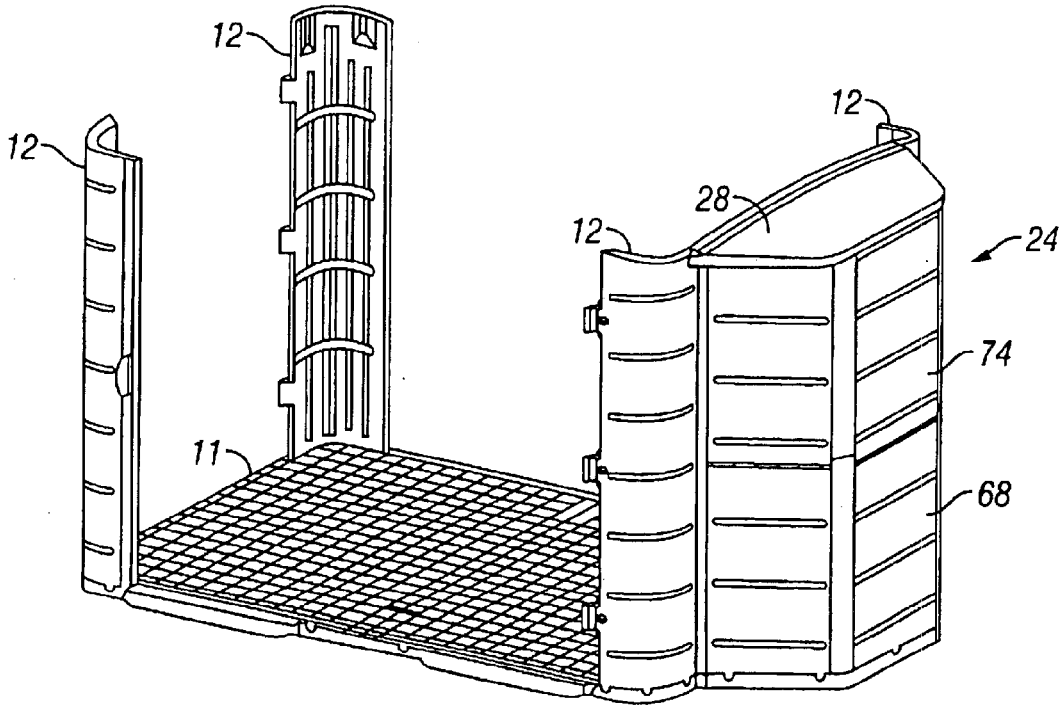
FIG. 16 is a perspective view of the corner posts and bay installed onto the floor.
Figure 17:
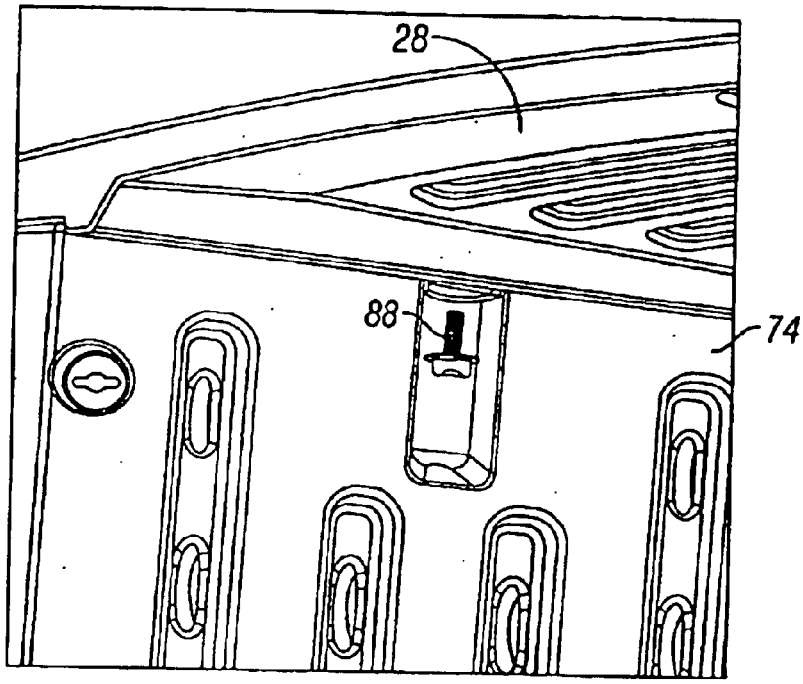
FIG. 17 is an interior perspective view of the bay illustrating a way to mount the bay roof to the upper wall of the bay.

In FIG. 16, the bay roof 28 is installed over the wall of the bay 24. The connection between the bay roof 28 and the upper wall 74 of the bay 24 is secured using bolts 88, as seen in FIG. 17. The bolts 88 may be the same as the plastic bolts 80, which extend through threaded apertures provided along the top edge of the upper wall 74 and the side edge of the bay roof 28.

Figure 18:
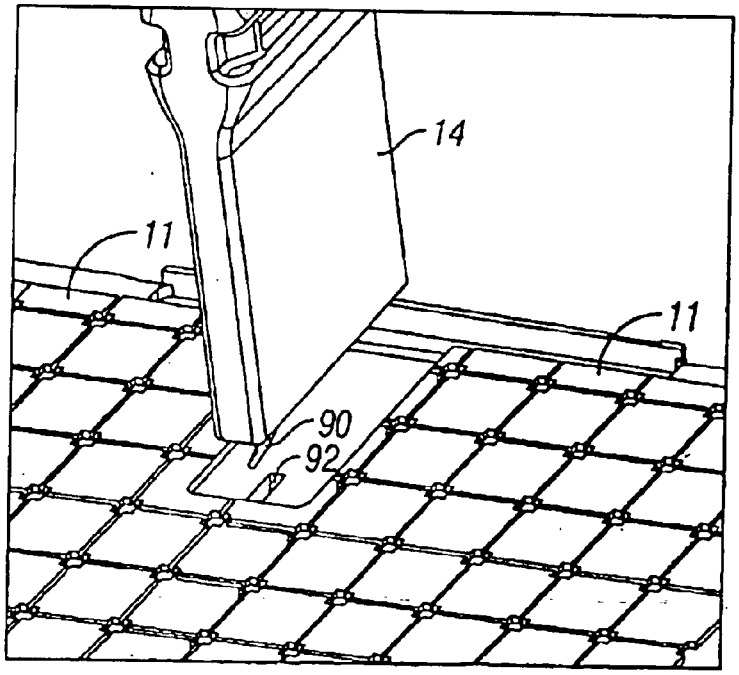
FIG. 18 is an interior perspective view illustrating a way to mount a brace to the floor in the shed of FIG. 1.
Figure 19:
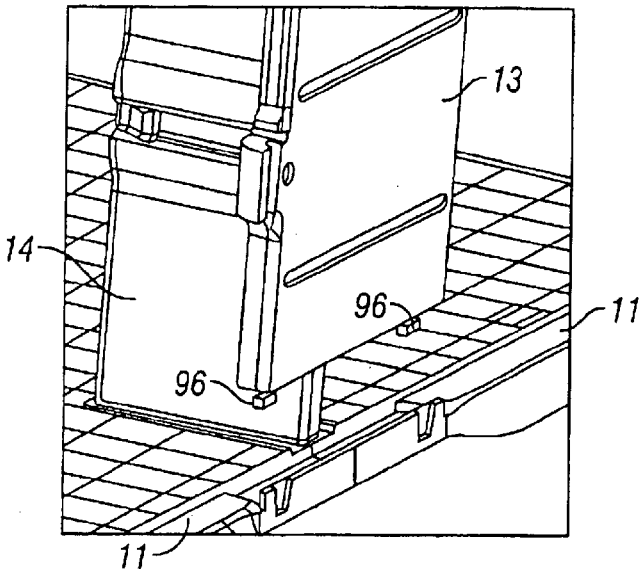
FIG. 19 is a perspective view illustrating a way to mount the center post to the floor in the shed of FIG. 1.
Figure 19A:
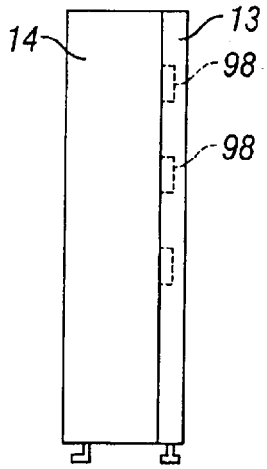
FIG. 19A is a simplified schematic view illustrating the connection between the brace and the center post.

The remaining structural supports to be installed are the center posts 13 and braces 14. In the embodiment shown, each brace 14 is installed first by inserting at least one bottom projection 90 into a groove or slot 92 provided in the floor pieces 11, as shown in FIG. 18. The bottom projection 90 may be shaped as a hook to be slid under the floor to provide a more secure connection and stable support for the brace 14. In FIG. 19, the center post 13 is installed by inserting bottom protrusions 96 each through the elongated opening 40 of the nut receiving seat 36 of the floor and the elongated aperture 44 of the corresponding floor locking nut 30, and locked by turning the floor locking nut 30, in a manner similar to that shown in FIGS. 10–12. Each center post 13 and the corresponding brace 14 may be further secured together, for instance, by fasteners or the like. In one embodiment, the brace 14 includes three side bumps 98 distributed along its edge facing the center post 13, which includes three corresponding indents aligned for receiving the side bumps 98 to be interlocked therewith, as schematically shown in FIG. 19A. For instance, the side bumps 98 and indents may be connected together by a tight fit or an interference fit.

Figure 20:
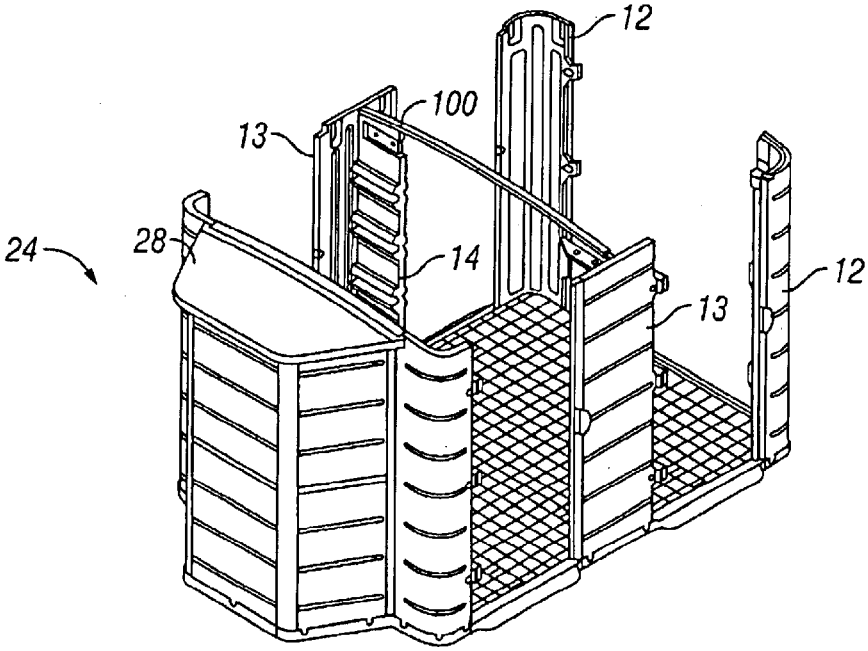
FIG. 20 is a perspective view of a lower roof truss connected across the braces of the shed of FIG. 1.
Figure 21:
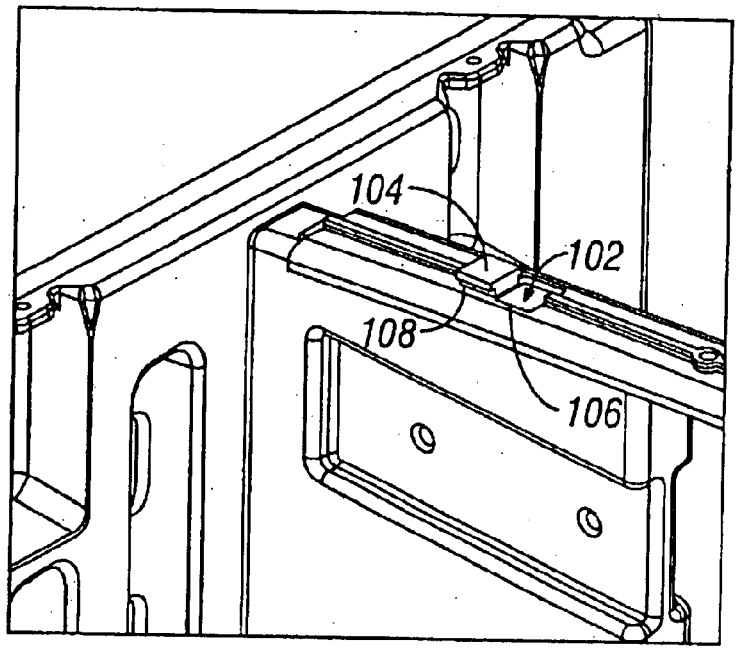
FIG. 21 is a perspective view illustrating a way to mount the lower roof truss to the braces.

In FIG. 20, a lower roof truss 100 is connected to the braces 14 prior to installing the roof panels 20. The lower roof truss 100 includes a spring preloaded to a slight bow shape. As best seen in FIG. 21, the lower roof truss 100 includes an elongated aperture 102 near each end for coupling with a boss 104 provided on top of the corresponding brace 14. The elongated aperture 102 has an enlarged portion 106 which is sized to allow the boss 104 to pass therethrough. The narrow neck of the boss 104 then slides to a narrow portion 108 of the elongated aperture 102 under the force of the spring preload on the lower roof truss 100 so as to lock the lower roof truss 100 in place with the braces 14. The spring preload thus provides self-locking of the lower roof truss 100 to the braces 14, and pulls the top of the braces 14 inward.

Figure 22:
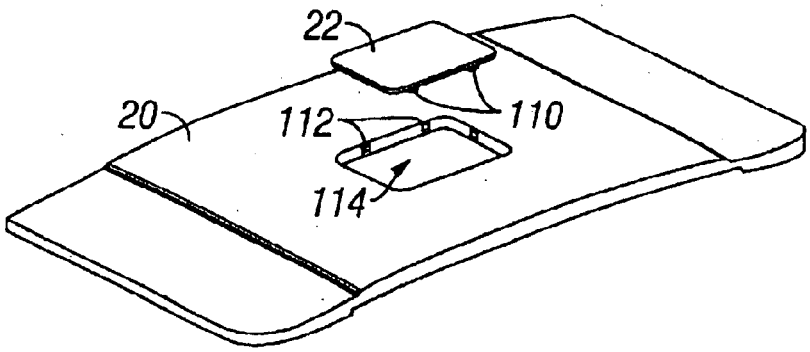
FIG. 22 is an exploded perspective view of a main roof panel and a skylight in the shed of FIG. 1.

The skylights 22 may be installed before or after the installing the roof panels 20. As shown in FIG. 22, each skylight 22 has feet 110 which are shaped to snap into slots 112 provided in the opening 114 of the roof panel 20. If the roof panel 20 has been installed on the shed 10 first, the skylight 22 can be inserted through the opening 114 from below and then dropped into position to align the feet 110 with the slots 112 to allow the feet 110 to be snapped into the slots 112. Advantageously, this can be done easily and quickly without any tools. Of course, different ways of mounting the skylights 22 to the roof panels 20 may be used in other embodiments.

Figure 23:
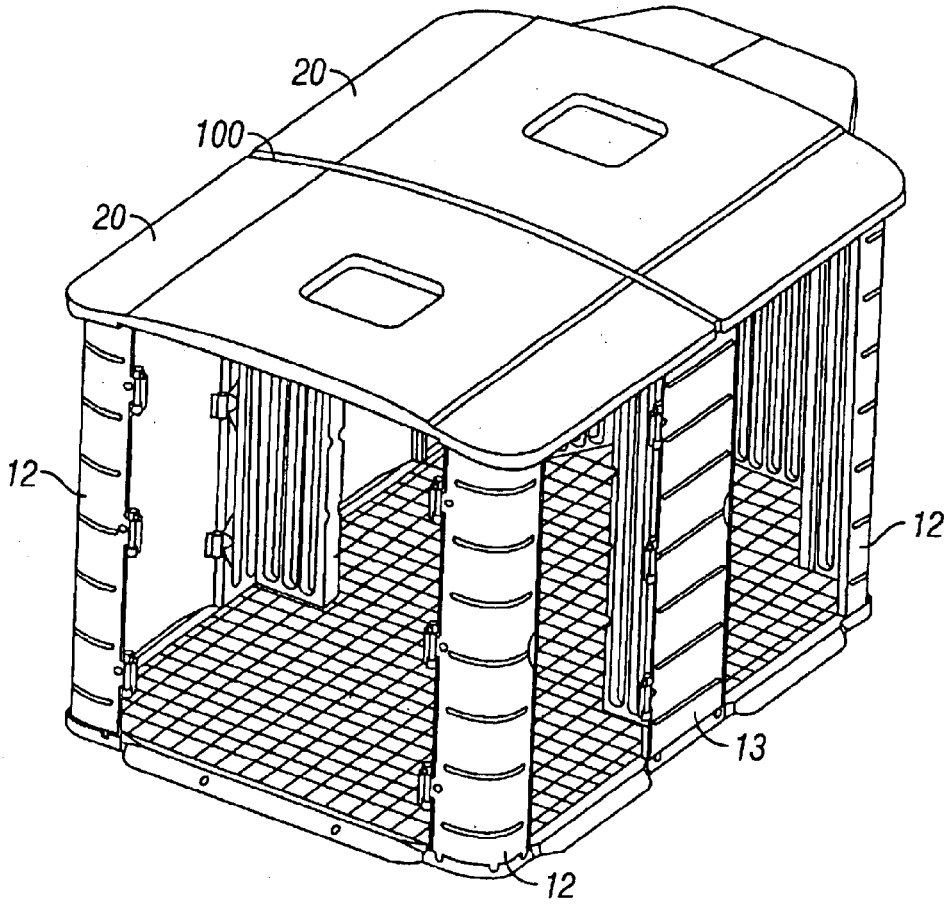
FIG. 23 is a perspective view of the main roof panels mounted onto the support posts of the shed.
Figure 24:
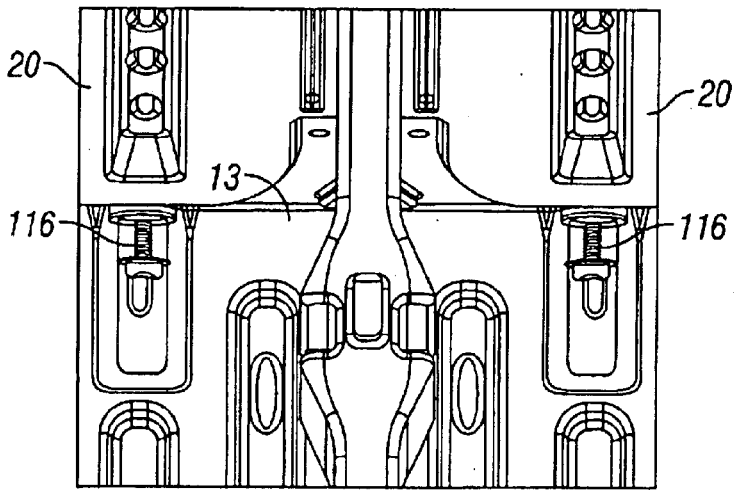
FIG. 24 is an interior perspective view of the center post illustrating a way to mount the main roof panels to the center post.
Figure 25:
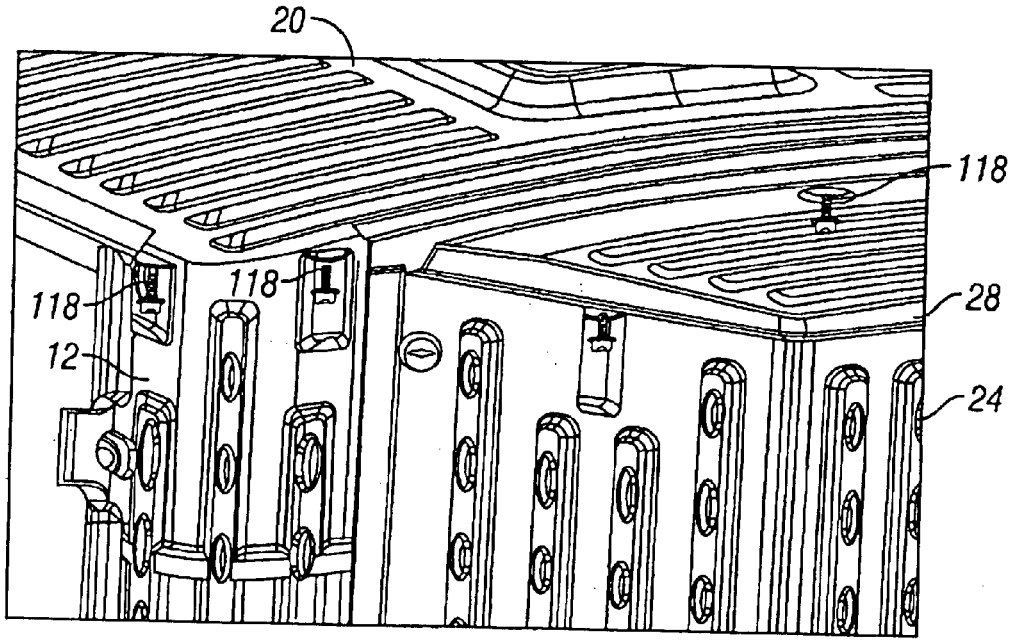
FIG. 25 is an interior perspective view illustrating a way to mount the main roof panels to the corner posts and the bay roof.

In FIG. 23, the roof panels 20 are placed over the corner posts 12 and center posts 13 with the lower roof truss 100 disposed between the roof panels 20. One way to fasten the roof panels 20 is by using bolts similar to the plastic bolts 80, 84 described above. FIG. 24 shows the use of plastic bolts 116 to attach the roof panels 20 to the center post 13 via threaded apertures provided along the top edge of the center post 13 and the side edges of the roof panels 20. FIG. 25 shows the use of plastic bolts 118 to attach the roof panel 20 to the corner post 12 via threaded apertures provided along the top edge of the corner post 12 and the side edge of the roof panel 20. Plastic bolts 118 may also be used to attach the bay roof 28 to the roof panel 20 via threaded apertures provided along the side edge of the roof panel 20 overlapping with the side edge of the bay roof 28.

Figure 26:
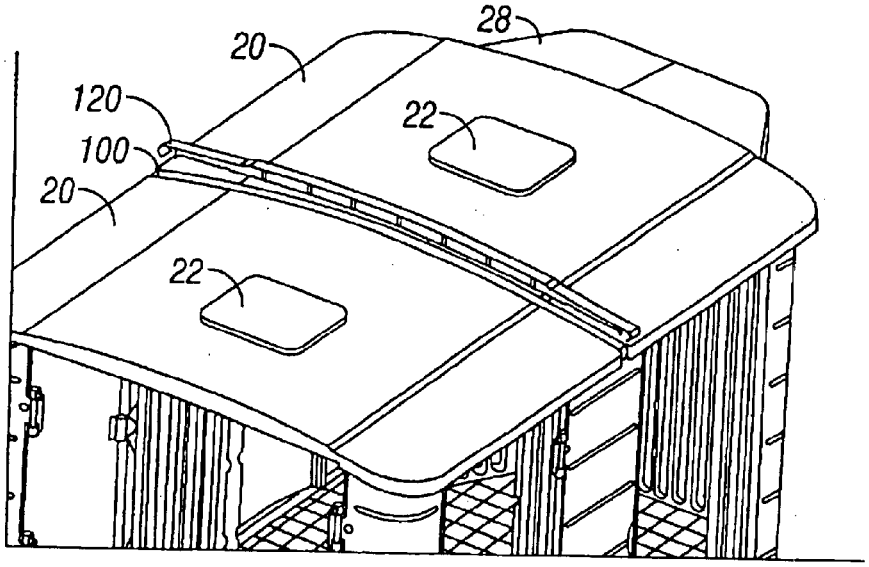
FIG. 26 is a perspective view of an upper truss to be attached to the roof of the shed.
Figure 27:
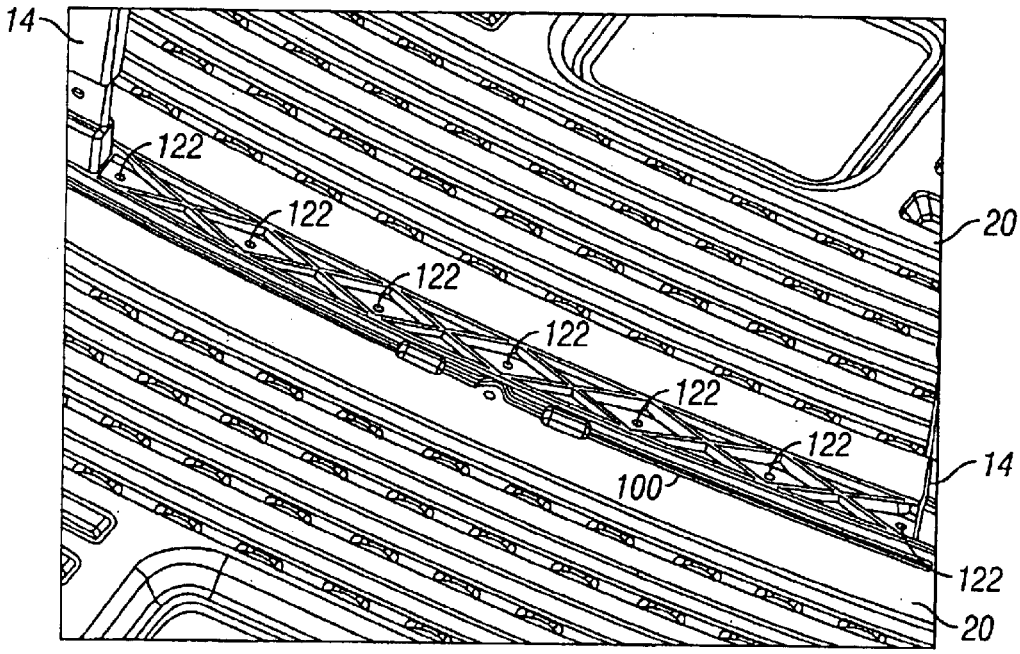
FIG. 27 is an interior perspective view illustrating the attachment of the upper truss to the lower roof truss.

To complete the roof installation, an upper truss 120 is attached to the lower roof truss 100, as seen in FIG. 26. In the embodiment shown, seven pan head self-tapping screws 122 are used to fasten the upper truss 120 to the lower roof truss 100, as illustrated in FIG. 27. The number and type of fasteners may be different in other embodiments. The upper truss 120 preferably provides a sealed connection between the roof panels 20 to prevent leakage. In other embodiments, the roof may comprise a single roof panel or more than two roof panels assembled together. The use of multiple roof panels that are smaller in size may facilitate easier handling and shipping.

Figure 28:
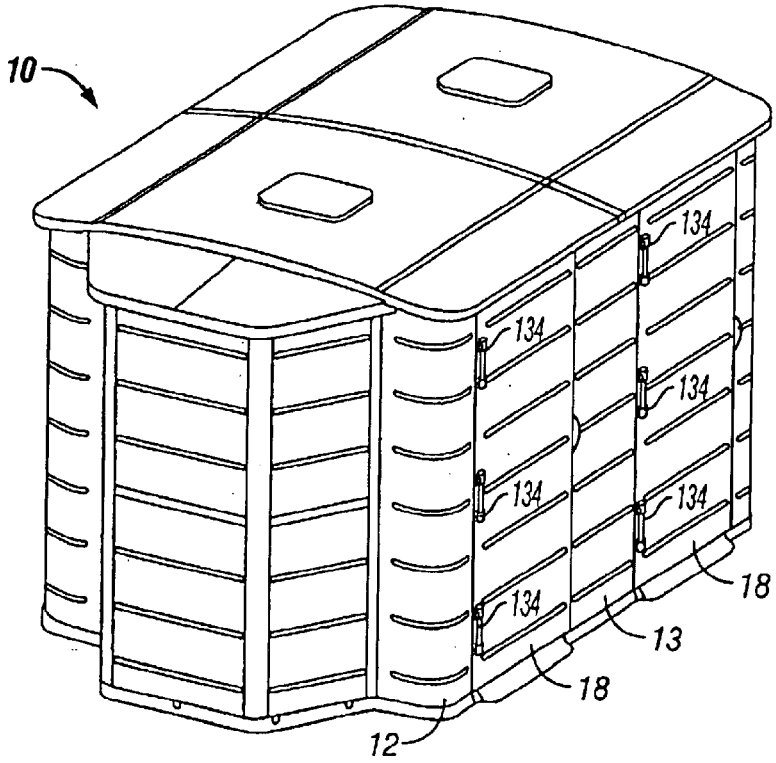
FIG. 28 is a rear perspective view of the shed of FIG. 1.
Figure 29:
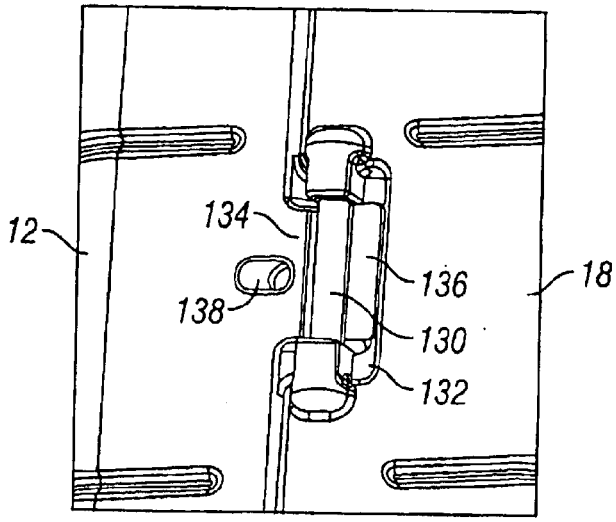
FIG. 29 is a perspective view of a portion of a hinge assembly for a door in the shed of FIG. 1.
Figure 30:
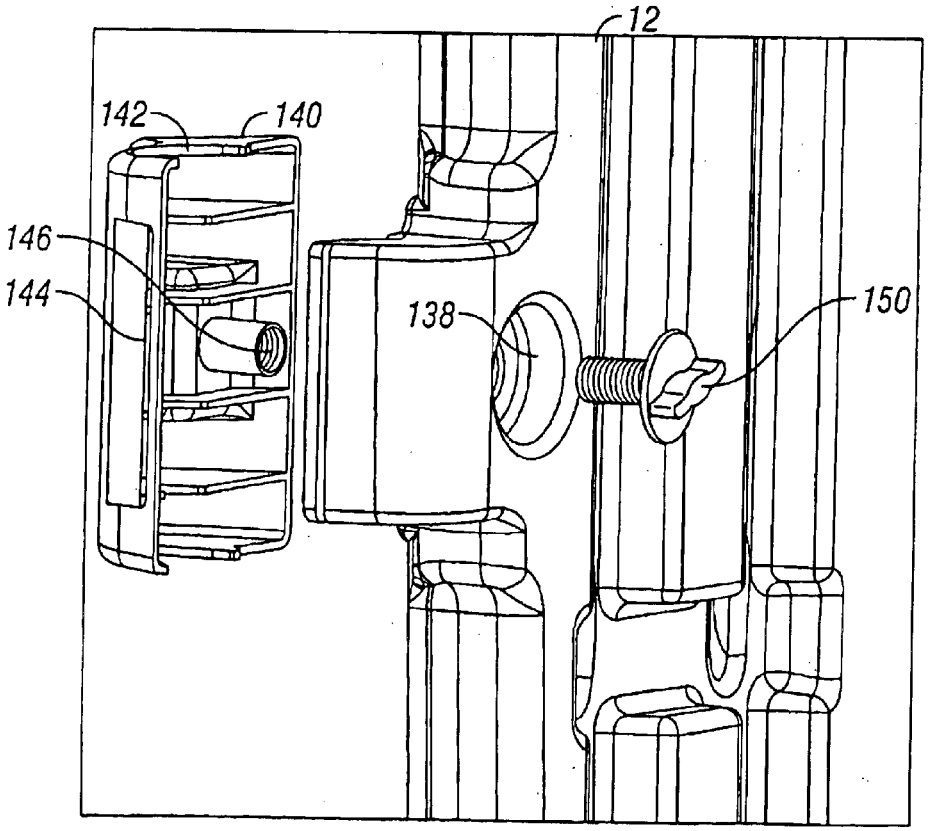
FIG. 30 is an exploded perspective view of the hinge assembly for the door of FIG. 29.
Figure 31:
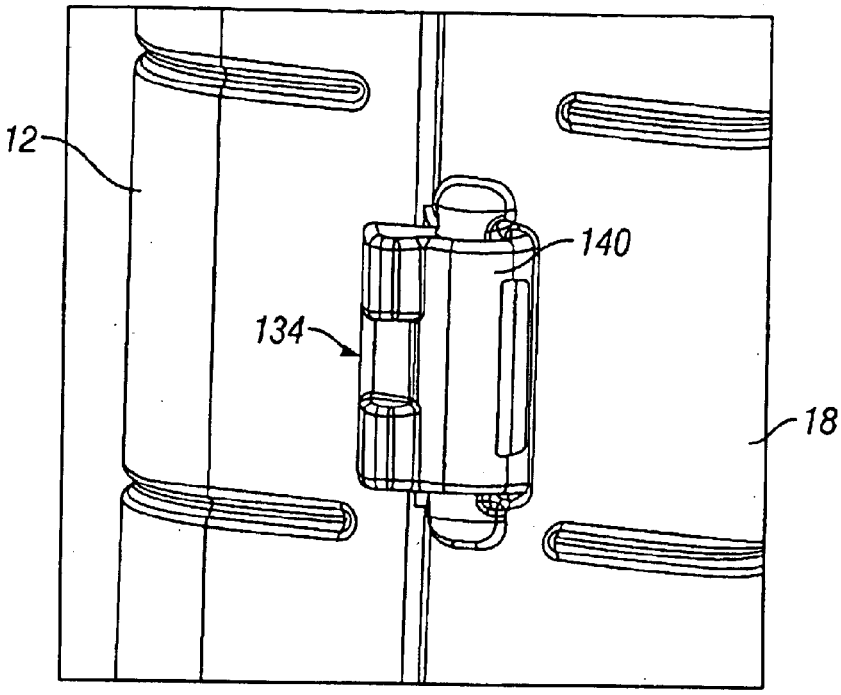
FIG. 31 is a perspective view of the hinge assembly for the door of FIG. 30.

The side doors 18 are installed by positioning each side door 18 to align a plurality of hinge posts 130 and openings 132 along the edge of the side door 18 with corresponding clips or hinge supports 134 of the corner post 12 or the center post 13, as shown in FIGS. 28 and 29. There are three hinge supports 134 for each side door 18 in the embodiment shown. The hinge support 134 has a rounded cutout that partially wraps around the hinge post 130, and includes an extension 136 which desirably extends along the length of the hinge post 130. The corner post 12 or center post 13 further includes a hole 138 disposed adjacent each hinge support 134. As shown in FIG. 30, a hinge cover member or hinge connection member 140 is then attached to complete the hinge assembly. The hinge cover member 140 has a rounded cutout 142 that partially wraps around the hinge post 130. An elongated slot 144 is provided to receive the extension 136 of the hinge support therethrough. This connection is made by passing a portion of the hinge cover member 140 through the opening 132 on the side door 18. The hinge cover member 140 includes a threaded aperture 146 which is aligned with the hole 138. A fastener such as a plastic screw 150 is used to fasten the hinge cover member 140 to the corner post 12 or center post 13 by extending the threaded screw 150 through the hole 138 into the threaded aperture 146. FIG. 31 shows the hinge cover member 140 connected to the hinge support 134 to complete the hinge assembly which allows the side door 18 to be hingedly supported and swing around the hinge assembly. The same hinge assemblies can be used to connect the front doors 16 to the two corner posts 12.

Figure 32:
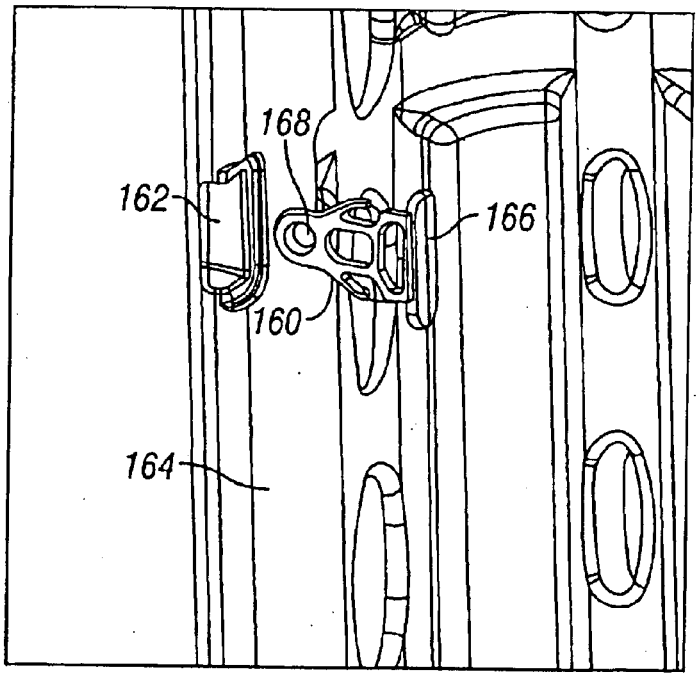
FIG. 32 is a rear perspective view of a hasp to be installed for a door.
Figure 33:
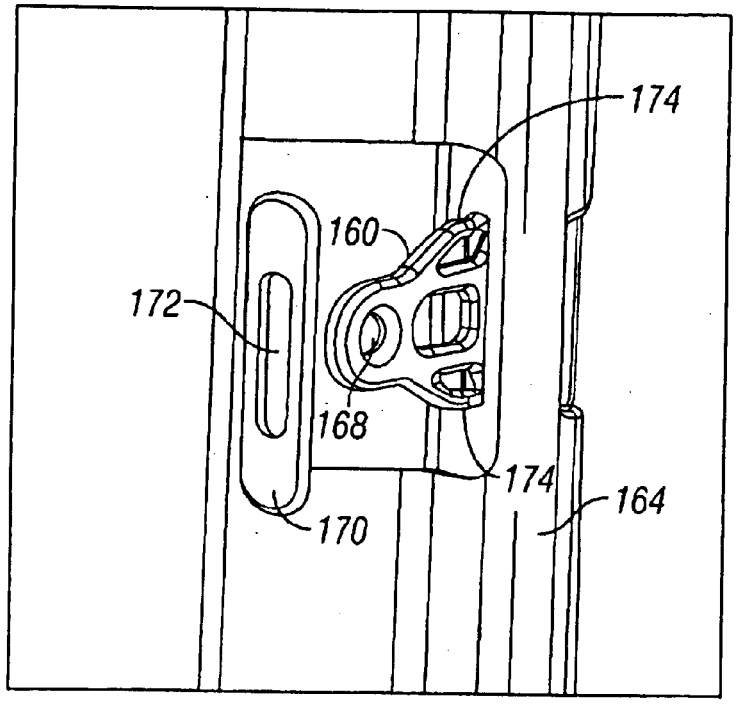
FIG. 33 is a front perspective view of the hasp of FIG. 32.

Each door has a locking feature that allows it to be locked from the outside of the assembled shed 10. As shown in FIG. 32, a hasp body 160 is inserted through a hole 162 provided in the mating door panel 164, which may be disposed along an edge of a corner post 12, a center post 13, or one of the two front doors 16. Alternatively, the hasp body 160 may be provided along the edge of the door to be coupled to a hasp bar which is attached to a corner post 12, a center post 13, or one of the front doors 16. As seen in FIG. 32, the hasp body 160 includes a rear portion 166 which bears against the back of the mating door panel 164. The front end of the hasp body 160 includes an aperture 168 for receiving a lock such as a padlock. To secure the hasp body 160 to the mating door panel 164, a hasp cover member or plate 170 having an elongated opening 172 is placed over the front end of the hasp body 160 against the front of the mating door panel 164. The hasp cover plate 170 may be fastened to the mating door panel 164 using any suitable methods. In the embodiment shown, the hasp cover plate 170 is conveniently snapped over the hasp body 160 as the elongated opening 172 is pushed over the fingers 174 of the hasp body 160. The fingers 174 snap over the hasp body 160 adjacent the ends of the elongated opening 172 and press the hasp body 160 securely against the mating door panel 164. The assembly is quick and easy, and does not require tools. After installing the hasp body 160, the corresponding door can be closed to insert the front of the hasp body 160 through an opening provided in the door or a hasp bar attached to the door, and a lock can be inserted through the aperture 168 of the hasp body 160 to lock the door.

Figure 34:
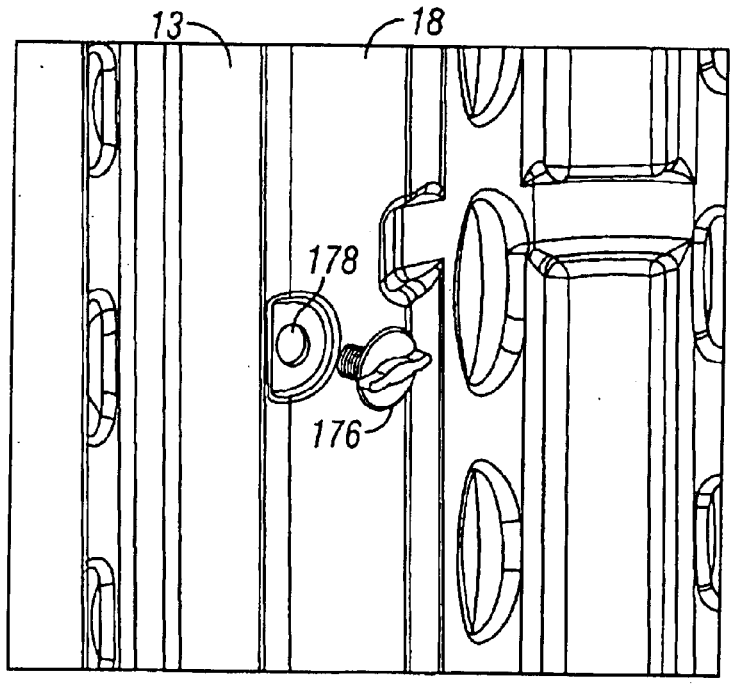
FIG. 34 is an interior perspective view illustrating a way to lock a side door from the interior of the shed.

The side doors 18 may also be locked from the inside of the shed 10. In one embodiment as shown in FIG. 34, a plastic bolt 176 is inserted through a threaded aperture 178 in the side door 18. The head of the plastic bolt 176 is sufficiently large to overlap with and act as a stop to bear against the edge of the center post 13 (or a corner post 12) so as to prevent the side door 18 from opening.

Figure 35:
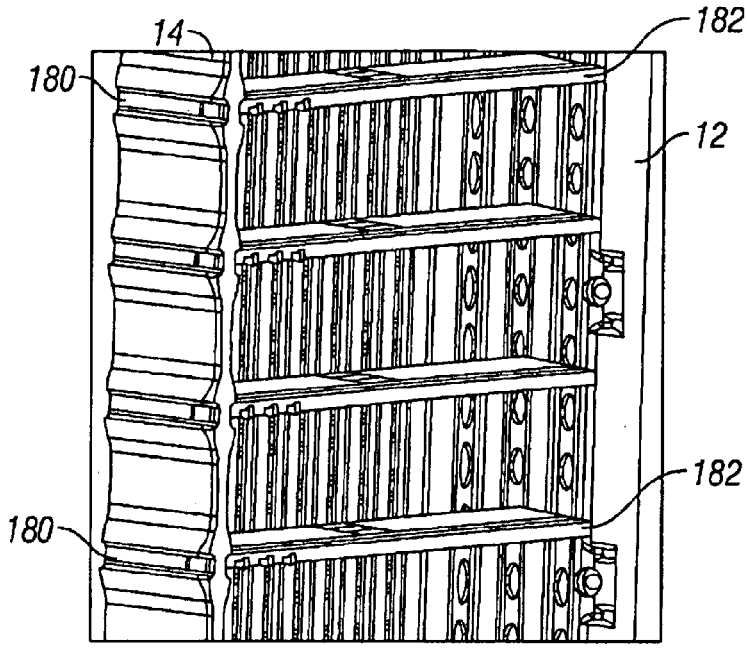
FIG. 35 is an interior perspective view of shelves installed between a corner post and a center post in the shed of FIG. 1.

The braces 14 and the corner posts 12 include horizontal grooves 180 for securely supporting shelves 182, as illustrated in FIG.35. The user can conveniently slide the shelves 182 into the grooves 180, and can select how many shelves 182 to install and where to place the shelves 182. Because the side doors 18 are provided between the corner posts 12 and the braces 14, the user can conveniently retrieve items stored on the shelves 182 by opening the side doors 18 without the need to physically enter the shed 10.

Figure 36:
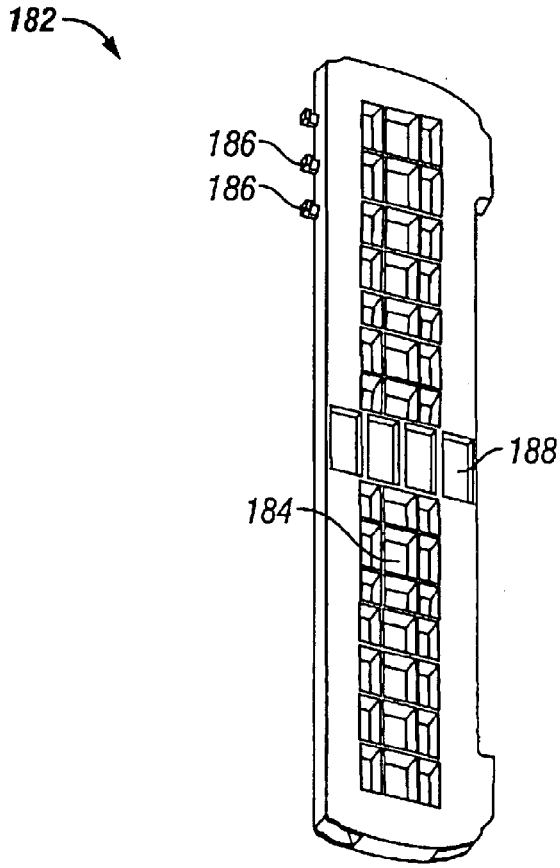
FIG. 36 is a perspective of a shelf according to an embodiment of the present invention.
Figure 37:
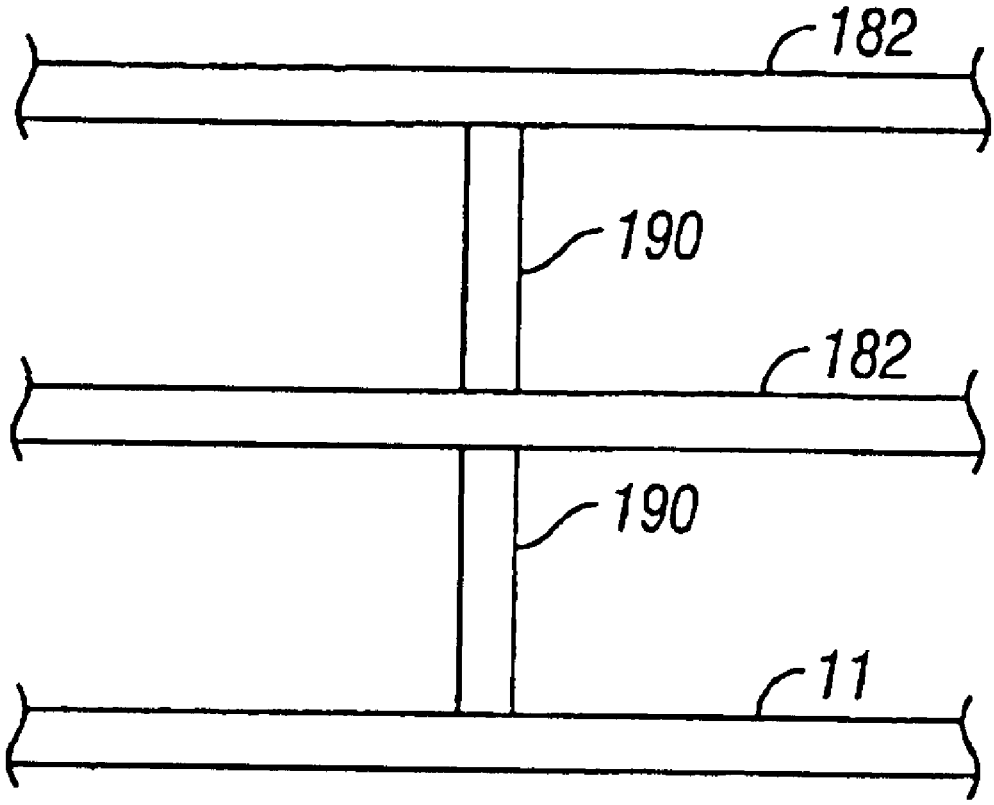
FIG. 37 is a schematic view illustrating vertical support members for the shelves.

FIG.36 shows an embodiment of the shelf 182, which includes a plurality of openings 184 for inserting items and hooks 186 for hanging items. Near the center are one or more slots or indentations 188 desirably on both the top and bottom sides of the shelf 182. The indentations 188 are configured to receive ends of vertical support members 190 that may be optionally provided between the floor and the shelf 182 or between two shelves 182 to provide additional support for heavy objects that may be placed on the shelves 182, as illustrated in FIG. 37. In specific embodiments, the indentations 188 are sizes to receive 2"×4" lumber pieces or the like.

Most or all of the components of the shed 10 may be made of plastic materials. The smaller pieces such as the bolts, nuts, and hinges may be made or preformed by injection molding, while the larger pieces such as the posts, braces, and roof panels may be made or preformed by blow molding.

The above-described arrangements of apparatus and methods are merely illustrative of applications of the principles of this invention and many other embodiments and modifications may be made without departing from the spirit and scope of the invention as defined in the claims. For instance, the various components of the shed may have different shapes and sizes from those shown herein, and may be made of different materials. A smaller shed may be formed using the four corner posts without the need for the center posts and braces. A another embodiment of the shed may be triangular in shape and formed by three corner posts instead of four corner posts. Yet another embodiment may include more than four corner posts. The scope of the invention should, therefore, be determined not with reference to the above description, but instead should be determined with reference to the appended claims along with their full scope of equivalents.

What is claimed is:

1. A storage shed comprising:

a preformed floor;

a plurality of preformed, plastic corner posts having bottoms which are configured to be mounted onto the floor to be spaced from each other;

two preformed, plastic braces having bottoms which are configured to be mounted onto the floor to be spaced from one another;

a preformed roof truss configured to be connected to tops of the two braces, the roof truss having a spring preload to pull the tops of the two braces toward one another;

a preformed roof attached to tops of the plurality of corner posts; and a preformed front door supported between two of the plurality of corner posts.

2. The storage shed of claim 1 wherein the braces each include a boss with a narrow neck at the top thereof; and wherein the roof truss includes an elongated aperture at each end having an enlarged aperture portion and a narrow aperture portion which is disposed between the enlarged aperture portion and the end of the roof truss, the boss of each brace being configured to be inserted through the enlarged portion and slide the narrow neck to the narrow portion of the aperture under the spring preload to pull the tops of the two braces toward one another.

3. The storage shed of claim 2 wherein the roof truss comprises a lower roof truss which is formed with the spring preload and which includes the apertures at the ends thereof.

4. The storage shed of claim 3 wherein the roof comprises two roof panels disposed on opposite sides of the lower roof truss.

5. The storage shed of claim 4 wherein the roof truss comprises an upper roof truss which is attached to the lower roof truss and forms a sealed connection between the two roof panels.

6. The storage shed of claim 1 further comprising two preformed, plastic center posts each connected to one of the braces at an angle, each center post having a bottom which is configured to be mounted onto the floor.

7. The storage shed of claim 6 wherein each brace is generally perpendicular to the center post to which the brace is connected, the brace having a height generally equal to the height of the center post to which the brace is connected.

8. The storage shed of claim 6 wherein each brace includes a plurality of side bumps which are aligned with and received into a plurality of slots of the center post.

9. The storage shed of claim 6 wherein the bottoms of the center posts include a plurality of protrusions which are each configured to be inserted into the floor and engage a floor locking nut to be tightened to lock the protrusions to the floor.

10. The storage shed of claim 1 wherein the bottom of each brace includes a hook-shaped projection which is configured to be inserted into a slot of the floor.

11. The storage shed of claim 1 wherein each brace includes at least one groove and each corner post includes at least one groove aligned with the groove of the brace to receive ends of a shelf to be positioned between the brace and the corner post.

12. The storage shed of claim 11 wherein the shelf comprises at least one indentation disposed in a middle region of the shelf, the at least one indentation being configured to receive an end of a vertical support member to be placed between the floor and the shelf or between a pair of shelves vertically spaced from one another and having indentations which are generally aligned with one another.

13. A method of assembling a storage shed, the method comprising:

providing a preformed floor;

mounting bottoms of a plurality of preformed, plastic corner posts onto the floor which are spaced from each other;

mounting bottoms of two preformed, plastic braces onto the floor which are spaced from one another;

connecting a preformed roof truss to tops of the two braces, the roof truss having a spring preload to pull the tops of the two braces toward one another;

attaching a preformed roof to tops of the plurality of corner posts; and supporting a preformed front door between two of the plurality of corner posts.

14. The method of claim 13 wherein connecting the roof truss comprises:

inserting a first boss with a narrow neck at the top of a first brace through a first aperture provided near a first end of a lower roof truss of the roof truss, the first aperture including an enlarged aperture portion and a narrow aperture portion which is disposed between the enlarged aperture portion and the first end of the lower roof truss; and inserting a second boss with a narrow neck at the top of a second brace through a second aperture provided near a second end of the lower roof truss of the roof truss, the second aperture including an enlarged aperture portion and a narrow aperture portion which is disposed between the enlarged aperture portion and the second end of the lower roof truss;

wherein the spring preload in the lower roof truss slides the narrow neck of the first boss to the narrow portion of the first aperture near the first end of the lower roof truss and slides the narrow neck of the second boss to the narrow portion of the second aperture near the second end of the lower roof truss, thereby pulling the tops of the two braces toward one another.

15. The method of claim 13 wherein attaching the roof comprises:

positioning a first roof panel on a first side of the lower roof truss and attaching the first roof panel to one or more corner posts disposed on the first side of the lower roof truss; and positioning a second roof panel on a second side of the lower roof truss and attaching the second roof panel to one or more corner posts disposed on the second side of the lower roof truss.

16. The method of claim 15 wherein an upper roof truss of the roof truss is attached to the lower roof truss and forms a sealed connection between the first and second roof panels.

17. The method of claim 13 further comprising:

mounting bottoms of two preformed, plastic center posts onto the floor which are spaced from one another; and connecting one brace to one center post and the other brace to the other center post.

18. The method of claim 17 wherein each brace is connected to the center post by aligning a plurality of side bumps of the brace with a plurality of slots of the center post which receive the plurality of side bumps.

19. The method of claim 13 further comprising providing at least one shelf; and sliding the at least one shelf between a groove on one of the braces and a groove on one of the plurality of corner posts which is aligned with the groove on the brace.

20. The method of claim 19 further comprising placing a vertical support member between the floor and an indentation disposed in a middle region of the shelf to support the shelf between the brace and the corner post.

* * * * *